US006213902B1

(12) United States Patent
Hagey et al.

(10) Patent No.: US 6,213,902 B1
(45) **Date of Patent: *Apr. 10, 2001**

(54) CONTOURED GRIP FOR A RACQUET

(76) Inventors: Edward H. Hagey, 3653 Jennifer St., San Diego, CA (US) 92117; William H. Hagey, 6621 Avenida Mirola, La Jolla, CA (US) 92037

( * ) Notice: Subject to any disclaimer, the term of this patent is extended or adjusted under 35 U.S.C. 154(b) by 0 days.

This patent is subject to a terminal disclaimer.

(21) Appl. No.: 09/271,996

(22) Filed: Mar. 18, 1999

Related U.S. Application Data

(63) Continuation-in-part of application No. 09/160,529, filed on Sep. 24, 1998, which is a continuation-in-part of application No. 08/963,549, filed on Nov. 3, 1997, now Pat. No. 5,931,749, which is a continuation-in-part of application No. 08/812,906, filed on Mar. 10, 1997, now Pat. No. 6,017,283, which is a continuation of application No. 08/459,302, filed on Jun. 2, 1995, now Pat. No. 5,671,926, which is a continuation-in-part of application No. 08/363,606, filed on Dec. 23, 1994, now Pat. No. 5,492,324, and a continuation-in-part of application No. 08/793,351, filed on Feb. 24, 1997, now Pat. No. 5,924,941.

(51) Int. Cl.[7] ..... A63B 49/08
(52) U.S. Cl. ..... 473/551; 473/549
(58) Field of Search ..... 473/549, 551, 473/298, 300, 568, 552

(56) References Cited

U.S. PATENT DOCUMENTS

| | | |
|---|---|---|
| 412,479 | 10/1889 | Davis . |
| 2,031,161 | 2/1936 | Hamel . |
| 2,166,044 | 7/1939 | Fletcher . |
| 2,166,045 | 7/1939 | Fletcher . |
| 2,302,191 | 11/1942 | Covington . |
| 3,189,069 | 6/1965 | Stowell . |
| 3,868,110 | 2/1975 | Jones . |
| 4,065,127 | 12/1977 | Fagen . |
| 4,067,573 | 1/1978 | Key, Jr. . |
| 4,072,311 | 2/1978 | Bertucci . |
| 4,213,609 | 7/1980 | Swanson . |
| 4,355,803 | 10/1982 | Rama . |
| 4,402,508 | 9/1983 | Pflueger . |
| 4,438,925 | 3/1984 | Lindstrom . |
| 4,537,399 | 8/1985 | Adam . |
| 4,545,584 | 10/1985 | Adam . |
| 4,641,838 | 2/1987 | Gabrielidis . |
| 4,664,381 | 5/1987 | Aaron . |
| 4,691,926 | 9/1987 | Adam . |
| 4,736,950 | 4/1988 | Doyle . |
| 4,828,261 | 5/1989 | Kleinlein . |
| 4,836,544 | 6/1989 | Lai . |
| 4,848,746 | 7/1989 | Klink . |

(List continued on next page.)

FOREIGN PATENT DOCUMENTS

| | | |
|---|---|---|
| 3628618 | 11/1987 | (DE) . |
| 3726753 | 2/1989 | (DE) . |
| 3733425 | 2/1989 | (DE) . |
| 3726753 | 8/1990 | (DE) . |
| 4019039 | 12/1991 | (DE) . |
| 519312A1 | 12/1992 | (EP) . |
| 2232337 | 2/1975 | (FR) . |
| 20882 | 5/1909 | (GB) . |
| 2133294 | 7/1984 | (GB) . |
| 662110 | 5/1979 | (SU) . |
| 157421 | 5/1991 | (TW) . |
| 210025 | 7/1993 | (TW) . |
| 2201699 | 2/1994 | (TW) . |
| 230376 | 9/1994 | (TW) . |
| WO8902297 | 3/1989 | (WO) . |

*Primary Examiner*—Raleigh W. Chiu
(74) *Attorney, Agent, or Firm*—Walter W. Duft

(57) ABSTRACT

A racquet handle having a contoured topography providing unique configurations that increase the player's racquet head awareness and which may be manufactured as an assembly adjustable along the length of the handle which will aid in positioning a player's hand in advantageous positions for stroke improvement.

13 Claims, 34 Drawing Sheets

U.S. PATENT DOCUMENTS

| | | | | |
|---|---|---|---|---|
| 4,934,024 | | 6/1990 | Sexton . | |
| 4,968,032 | | 11/1990 | Redekop . | |
| 5,018,734 | | 5/1991 | Allsop . | |
| 5,034,082 | | 7/1991 | Nolan . | |
| 5,042,804 | | 8/1991 | Uke . | |
| 5,064,203 | | 11/1991 | Hattori . | |
| 5,269,516 | | 12/1993 | Janes . | |
| 5,295,684 | | 3/1994 | Bracho . | |
| 5,316,316 | | 5/1994 | Lai . | |
| 5,322,278 | | 6/1994 | Jeanrot . | |
| 5,398,930 | | 3/1995 | Gibson . | |
| 5,460,372 | | 10/1995 | Cook . | |
| 5,482,270 | | 1/1996 | Smith . | |
| 5,492,324 | | 2/1996 | Hagey . | |
| 5,556,092 | | 9/1996 | Theken . | |
| 5,599,019 | | 2/1997 | Davis et al. . | |
| 5,653,643 | | 8/1997 | Falone et al. . | |
| 5,657,985 | | 8/1997 | Dalstrom et al. . | |
| 5,671,926 | | 9/1997 | Hagey . | |
| 5,690,560 | | 11/1997 | Ruiz . | |
| 5,890,972 | | 4/1999 | Huang . | |
| 5,924,941 | * | 7/1999 | Hagey | 473/551 |
| 5,931,749 | * | 8/1999 | Hagey | 473/551 |

* cited by examiner

FIG. 15
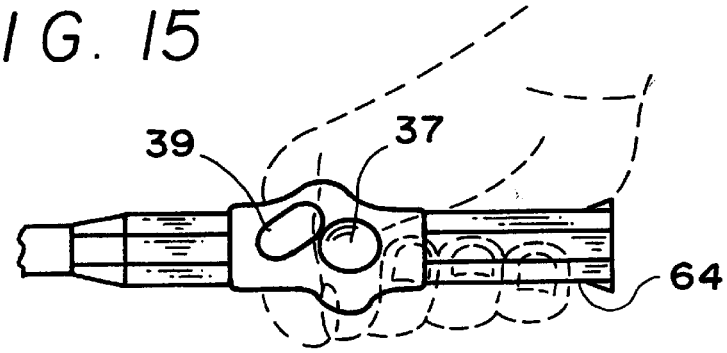
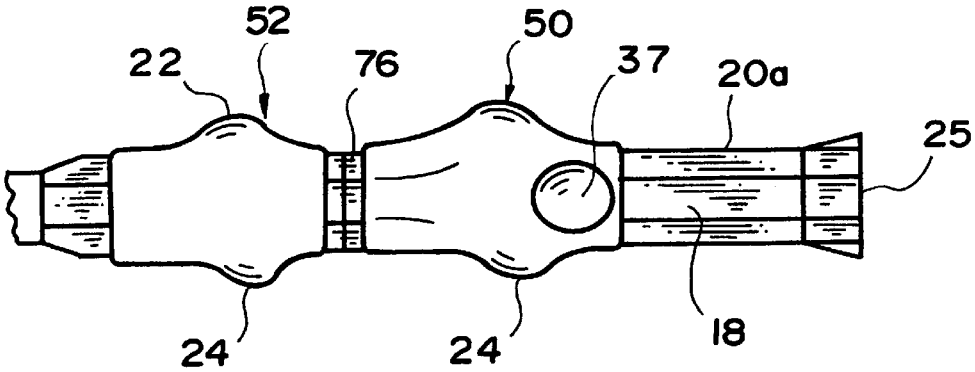
FIG. 16
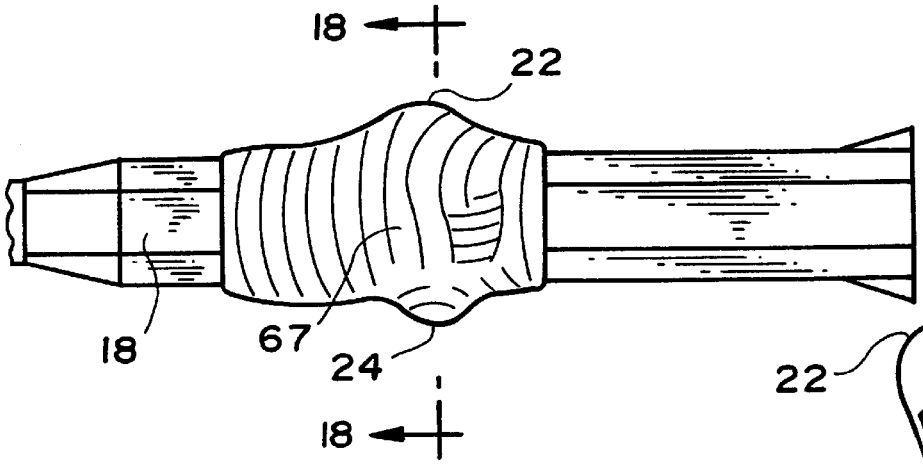
FIG. 17
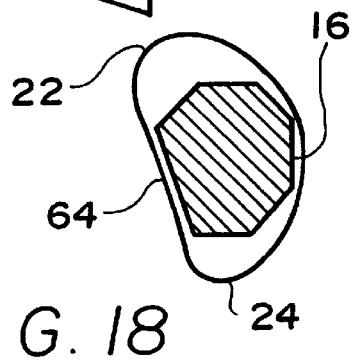
FIG. 18

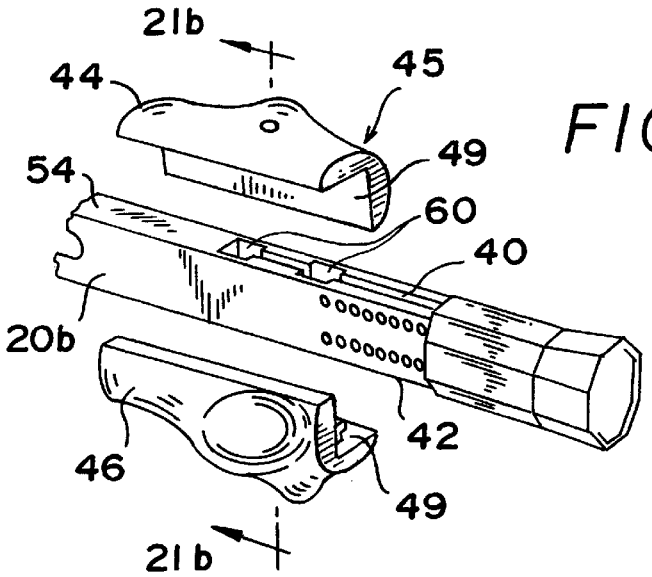
FIG. 19b
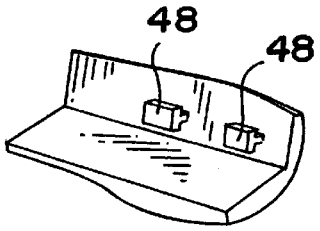
FIG. 20b
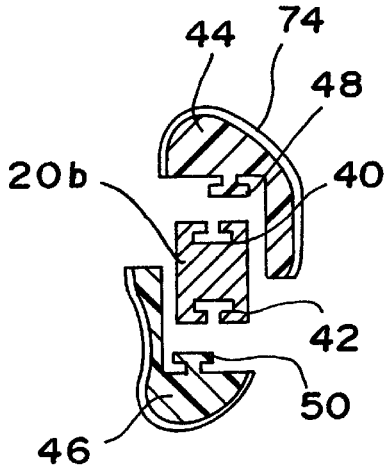
FIG. 21b
FIG. 22b
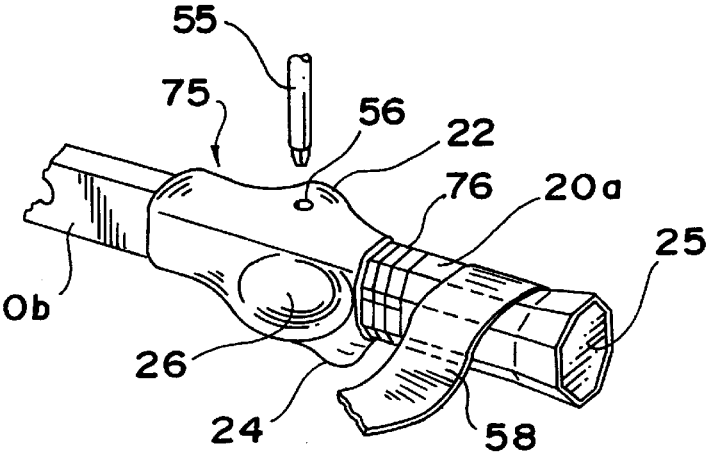
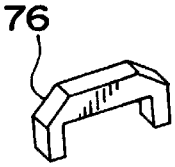
FIG. 23
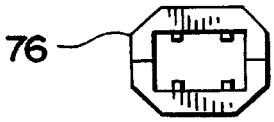
FIG. 24

CONTOURED GRIP FOR A RACQUET

BACKGROUND OF THE INVENTION

This is a continuation-in-part of co-pending U.S. application Ser. No. 09/160,529 filed Sep. 24, 1998, which is itself a continuation-in-part of U.S. application Ser. No. 08/963,549 filed Nov. 3, 1997, now U.S. Pat. No. 5,931,749 which is itself a continuation-in-part of U.S. patent application Ser. No. 08/812,906 filed Mar. 10, 1997, now U.S. Pat. No. 6,017,283 which is itself a continuation of U.S. patent application Ser. No. 08/459,302 filed Jun. 2, 1995, now U.S. Pat. No. 5,671,926, and which is itself a continuation-in-part of U.S. patent application Ser. No. 08/363,606 filed Dec. 23, 1994, now U.S. Pat. No. 5,492,324. This is also a continuation-in-part of U.S. patent application Ser. No. 08/793,351 filed Feb. 24, 1997 now U.S. Pat. No. 5,924,941.

The present invention is directed to further improvements in racquets for use in several sports, but is particularly directed toward an improved gripping area for a tennis racquet handle.

Of all the racquet sports, tennis is unique in its ball speed (pace) and the great deal of court coverage required by the players. Players must hit many balls on the run or after traveling great distances. For expert play, it is essential that during these maneuvers the player have a superb sense or awareness of the location and attitude (angular disposition) of the racquet head with respect to the player's hand. Sometimes the ball must be struck when it has little or no speed. At other times, the racquet will encounter high impact forces because of the pace with which the opponent has struck the ball. Additionally, the player must return tennis balls with various spins. The player is oftentimes required to change grips while on the run. Racquet preparation and proper grip are essential to expert play. Players must change their grips while running and under other difficult circumstances.

There have been many improvements in tennis racquets in the past several decades. Prior to 1970, almost all racquets were made of laminated wood. This limited the size of racquet heads and, consequently, almost all racquet heads had the same dimensions. For many years, manufacturers have made handles of different peripheral sizes, almost all of which were octagonal. With the advent of steel, aluminum, fiberglass, and graphite racquets, size limitations have been substantially eliminated and racquet heads have become larger.

With larger racquet heads, off-center contact with the ball creates greater torque. When a fast-moving tennis ball is struck any place but in the so-called "sweet spot," a great deal of torque is imparted to the racquet which must be resisted by the hand of the racquet user. This makes racquet head awareness of even greater importance. Racquet head awareness is that sense of knowing the angular relationship and distance of the stringed head to the hand. Topographical features on the handle which are felt and recognized by the player's hand enhance awareness. Although conventional octagonal handles impart some awareness, the instant invention described herein increases awareness It dramatically.

For almost a century, tennis racquet handles have been octagonal in cross section. After about 1930, it became common to wrap the octagonal handle with a leather strip for comfort and friction. This racquet handle design is almost universally used in tennis racquets at the present time. Before leather wrappings became popular, many handles had grooves and ridges to increase friction. A collar or retention ridge was often secured to the base end of the handle to prevent slippage.

In order to appreciate the full measure of this invention, it should be understood that the vast majority of players use two different grips when stroking the ball. One grip is used for the forehand and the other grip is used for the backhand. Players typically use the backhand grip, or a grip between the forehand and backhand grip, for the serve. Grips vary from player-to-player and the teachings herein disclose handles which will accommodate the requirements of many players.

The most common forehand grip (known as the Eastern forehand), and that preferred by many tennis instructors, places the first knuckle of the index finger squarely behind one of the planar surfaces of the octagonal handle, the palm is in engagement with that planar surface parallel to the plane of the racquet head, and the butt of the hand against a retention ridge. The fingers are angularly disposed with respect to the handle axis.

In the grip known as the Eastern backhand, the hand is rotated until the finger segments between the first and second knuckles of the third, fourth, and fifth fingers are in a plane parallel to the racquet head. The thumb is typically placed diagonally across the opposite planar surface. This specification will use this grip terminology for purposes of explanation.

Some players do not like the "feel" of these commonly-used grips and will rotate the hand to one side or the other. This can reduce power and, in many instances, reduce racquet head awareness. In the embodiments described herein, contours are disclosed which will accommodate a variety of grips without the loss of power or racquet head awareness. In some instances, an improper grip is assumed because of a lack of skill or because of the difficult circumstances encountered during a grip change. The configuration and contours of the handle herein described will permit a considerable array of grips and at the same time aid the user in reaching a desired grip.

As taught in my co-pending applications, there is a bowl or protrusion to receive the area between the thumb and forefinger and a trigger to receive the index finger. The protrusion and the trigger increase the player's awareness of his or her hand along the length of the handle and increase racquet control. In one embodiment of the instant invention, a second protrusion is provided adjacent the trigger so that the player will have additional racquet handle awareness and control during certain strokes. In another embodiment of the instant invention, the first protrusion is located on one side of the handle axis and defines a surface extending at a skewed angle to the axis to engage the base of a player's index finger. If desired, the first protrusion can be extended beyond the side of the handle. In addition, a thumb depression can be provided below the first protrusion and an extended thumb support lip can be provided below the thumb depression. In another embodiment of the instant invention, an angled surface is provided on one side of the handle to support the first knuckle of a user's forefinger in a Western forehand grip. In yet another embodiment of the instant invention, a concavity is provided in the handle to receive a player's third, fourth, and fifth fingers, which helps facilitate a backhand grip. In a further embodiment of the instant invention, a thumb groove can be provided approximately transverse of the axis of the racquet so that a Western backhand is facilitated. In still another embodiment of the instant invention, a pair of thumb depressions are provided. In a still further embodiment of the instant invention, a pair of handle contour areas are provided for two-handed backhand play. One contour area is for the right hand and one is for the left hand. In a still further embodiment, an angled surface is provided for a user's thumb to facilitate top spin backhand strokes. In a still further embodiment, a thumb depression is formed in combination with either a bowl or protrusion to receive the area between the thumb and forefinger, or a trigger to receive the index finger. Alternatively, either a bowl or protrusion, or a trigger, could be provided by itself without a thumb depression. In a still further embodiment for two-handed backhand use, a single contour area is provided that includes a protrusion to receive the area between the thumb and forefinger of the principal playing hand, a trigger to receive the index finger of the principal playing hand, and an angled depression formed in the racket head side of the protrusion to receive the padded area at the base of the thumb of the secondary playing hand. The side of the handle can also be angled to receive the first knuckle of the index finger of the secondary playing hand. In yet another embodiment, a concavity in the upper side of the handle receives the butt of the principal playing hand to bring the grasping fingers closer together and provide a better grip. The trigger can also be positioned toward the base of the handle relative to the protrusion so that the thumb of the principal playing hand can engage the trigger during backhand strokes. In a still further embodiment, one or more indentations are formed in a side portion of the handle to receive the first knuckle of the index finger of the principal playing hand for positioning during service and forehand strokes.

In addition to the foregoing embodiments, novel constructions in accordance with the invention allow contoured areas formed in accordance with the invention to be adjustably mounted on a conventional handle as an alternative to molding a contour on a handle during racquet manufacture. Alternatively, permanent contours can be implemented in conjunction with removable handle base members of different size. In addition, molded constructions are disclosed that allow the weight of the racket handle to be reduced. A racquet for a right-handed player is described herein, but it should be understood that left-handed racquets are just the reverse.

SUMMARY OF THE INVENTION

With the above in mind, this invention has a principal objective to provide a new handle configuration for a tennis racquet which combines the geometry of the player's hand with preferred racquet movement so that maximum power and control is obtained by the user.

A further objective of this invention is to provide a handle configuration which makes the player fully aware of the location of his hand along the length of the handle.

Another objective of the invention is to provide a bowl or protrusion to receive the area of a user's hand between the thumb and forefinger, and a trigger to receive the index finger. The protrusion and the trigger increase the player's awareness of his or her hand along the length of the handle and increase racquet control.

Still another objective of the invention is to provide a second protrusion adjacent the trigger so that the player will have additional racquet handle awareness and control during certain strokes.

Still another objective of the invention is to locate the first protrusion on one side of the handle axis and define a surface extending at a skewed angle to the axis to engage the base of a player's index finger. If desired, the first protrusion can be extended beyond the side of the handle. In addition, a thumb depression can be provided below the first protrusion and an extended thumb support lip can be provided below the thumb depression.

Still another objective of the invention is to provide an angled surface on one side of the handle to support the first knuckle of a user's forefinger in a Western forehand grip.

Still another objective of the invention is to provide a concavity in the handle to receive a player's third, fourth, and fifth fingers, which helps facilitate a backhand grip.

Still another objective of the invention is to provide a thumb groove approximately transverse of the axis of the racquet so that a Western backhand grip is facilitated.

Still another objective of the invention is to provide a pair of thumb depressions.

Still another objective of the invention is to provide a pair of handle contour areas for two-handed backhand play. One contour area is for the right hand and one is for the left hand.

Still another objective of the invention is to provide an angled surface for a user's thumb to facilitate top spin backhand strokes.

Still another objective of the invention is to provide a thumb depression in combination with either a bowl or protrusion to receive the area between the thumb and forefinger, or a trigger to receive the index finger. Alternatively, either a bowl or protrusion, or a trigger, could be provided by itself without a thumb depression.

Still another objective of the invention is to provide, for two-handed backhand use, a single contour area that includes a protrusion to receive the area between the thumb and forefinger of the principal playing hand, a trigger to receive the index finger of the principal playing hand, and an angled depression formed in the racket head side of the protrusion to receive the padded area at the base of the thumb of the secondary playing hand. A related objective is to angle the side of the handle to receive the first knuckle of the index finger of the secondary playing hand.

Still another objective is to provide a concavity in the upper side of the handle to receive the butt of the principal playing hand to bring the grasping fingers closer together and provide a better grasp. In accordance with this objective, the trigger can also be positioned toward the base of the handle relative to the protrusion so that the thumb of the principal playing hand can engage the trigger during backhand strokes.

Still another objective is to form one or more indentations in a side portion of the handle to receive the first knuckle of the index finger of the principal playing hand for positioning during service and forehand strokes.

In the handle configurations described herein and those described by my co-pending applications, it may be desirable to be able to cast or otherwise pre-form these configurations and secure them at selective locations along the length of the handle to improve a player's performance. In one system, the handle is formed with a grooved section along a portion of its length in which rail portions of the grip are received. The grip molds are moved along the length of the racquet handle to a desired location and secured thereto by screws or the like. Then, the racquet handle is wrapped with leather strips as is conventional.

In another system, a contour section is added to a handle using multiple pieces secured to the handle by adhesive. In yet another system, a contour area is molded or otherwise attached on a racket using light weight material to reduce handle weight. In still another system, a contour area is formed on a sheet of foldable material that is wrapped around the racquet handle. In still another system, a contour area is formed on a resilient boot that slides over the end of the racquet handle. In a final system, a permanently mounted contour member is provided and removable handle base members are provided for altering the distance between the contour area and the base end of the racquet handle.

BRIEF DESCRIPTION OF THE DRAWINGS

FIG. 15 is a side elevational view showing a configuration having two thumb depressions and a reduced base periphery according to another embodiment of the invention;

FIG. 16 is a side view disclosing two contoured areas on the handle shaft according to another embodiment of the invention for those using a two-handed grip;

FIG. 17 is a side view according to another embodiment of the invention showing a contoured surface that eliminates one of the ridges of the handle;

FIG. 18 is a cross-sectional view of the racquet handle of FIG. 17 taken along line 18—18 therein;

FIG. 19*b* is an exploded perspective showing a two-piece contour assembly in accordance with another method of implementing the invention;

FIG. 20*b* is a partial bottom view of one of the contour elements shown in FIG. 19*b* disclosing inwardly directed rails;

FIG. 21*b* is a cross section taken along line 21*b*—21*b* in FIG. 19*b* showing the contour elements formed as a contour assembly;

FIG. 22*b* is a perspective of a handle in accordance with FIG. 19*b* during the final stages of assembly;

FIG. 23 is a perspective view of a two-piece spacer piece;

FIG. 24 discloses how the spacer pieces of FIG. 23 engage one another;

FIG. 54, which includes sub

DESCRIPTION OF THE PREFERRED EMBODIMENTS

Figure 1:
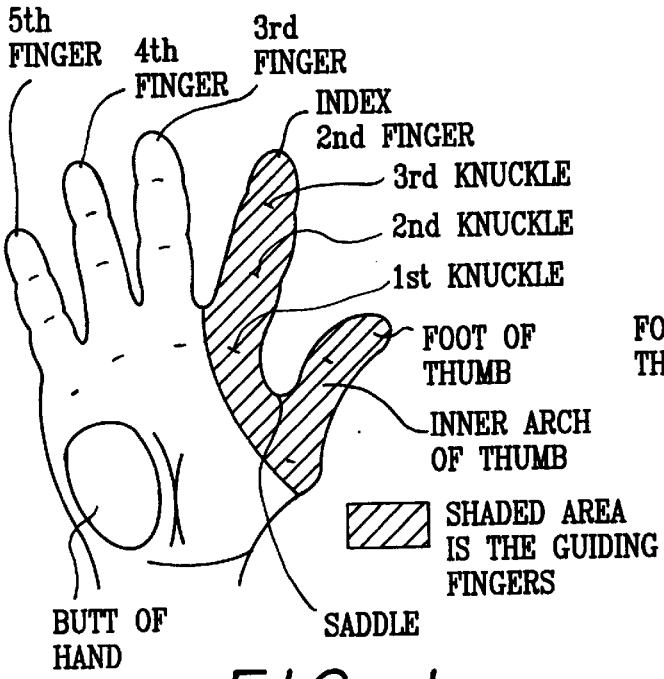
FIGS. 1–3 are views of the hand presented for purposes of nomenclature.
Figure 2:
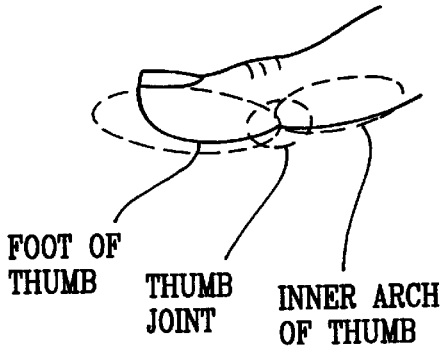
Figure 3:
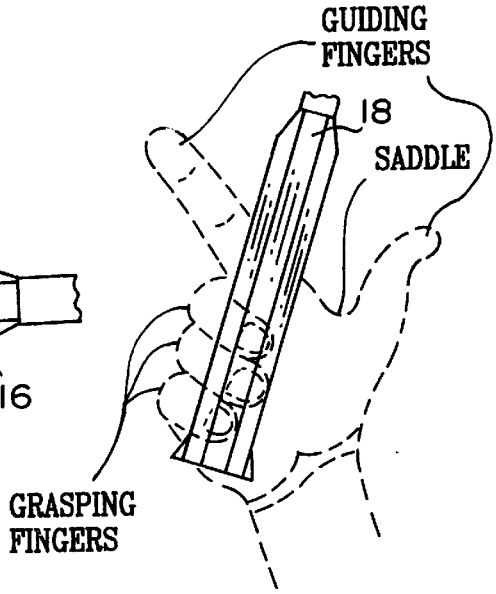

For nomenclature purposes, please refer to FIGS. 1, 2, and 3 showing the hand of a tennis player. Note that the index finger, thumb, and the saddle area have been shaded.

These portions of the hand contribute guidance and control to the player. The third, fourth, and fifth fingers provide much of the grasping power. FIG. 3 illustrates this concept.

Figure 4:
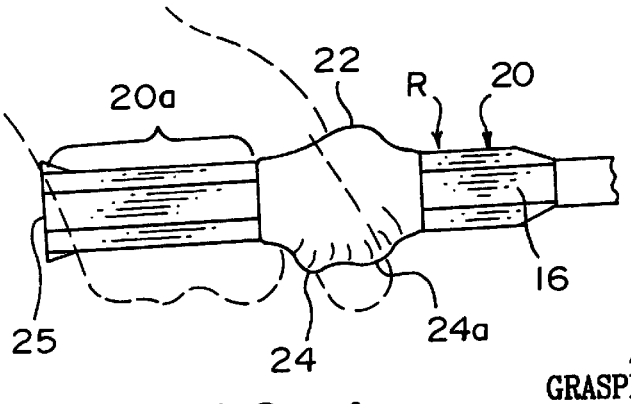
FIG. 4 is a diagrammatic side view showing a player's hand disposed over a tennis racquet handle constructed according to one embodiment of this invention.

Referring now to the other drawings wherein like numerals indicate like parts, and FIG. 4 in particular, the numeral 20 indicates a tennis racquet handle of the racquet R. The numeral 20*a* indicates a lower portion of the handle 20 adjacent a base 25. The tennis racquet handle 20, including the lower portion 20*a*, includes side surfaces 16 and 18 as shown in FIGS. 3 and 4. The top surface of the octagonal portion of the handle is indicated by the numeral 19 and the bottom surface by the numeral 19'. In the parent applications a protrusion 22 and a trigger 24 have been disclosed. The protrusion 22 provides a surface against which the saddle formed by the index finger and the thumb can be placed. This engagement locates the hand and/or acts as a pivotal point when changing from forehand to backhand grips and vice versa. The trigger 24 supports the player's index finger for added control and for increasing the player's awareness of his or her hand along the length of the handle.

Figure 5:
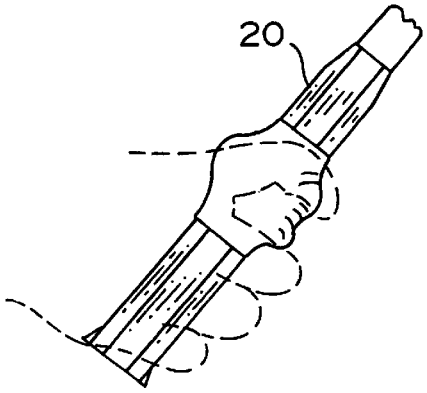
FIGS. 5 and 6 are diagrammatic side elevational views to illustrate operation.
Figure 6:
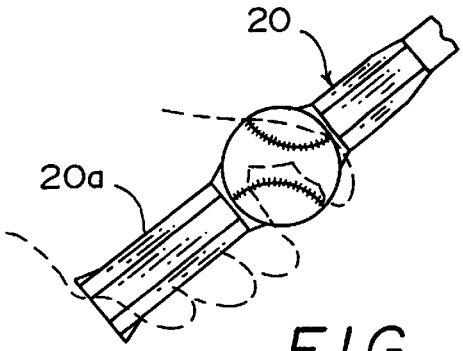

As seen in a new embodiment shown in FIG. 4, another bulge 24*a* can be added adjacent the trigger 24. The rounded surface of bulge 24*a* causes the hand to lengthen or stretch itself along the racquet and locates a portion of the index finger radially outwardly from the axis of the handle for better control and racquet head awareness for some players. The player will engage this surface 24*a*, especially in the serve and overhead, to give an extra downward force on the racquet head as the plane of the head is moving forward. This provides an extra snap action to the racquet head, much in the same way a baseball pitcher obtains spin on his curve. FIGS. 5 and 6 are diagrammatic representations of this phenomenon.

Figure 7:
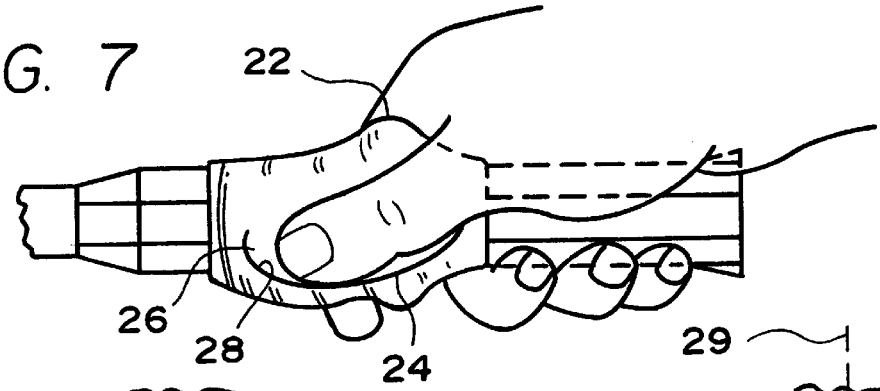
FIG. 7 is a left side elevation showing a backhand grip of another embodiment of the present invention.
Figure 8:
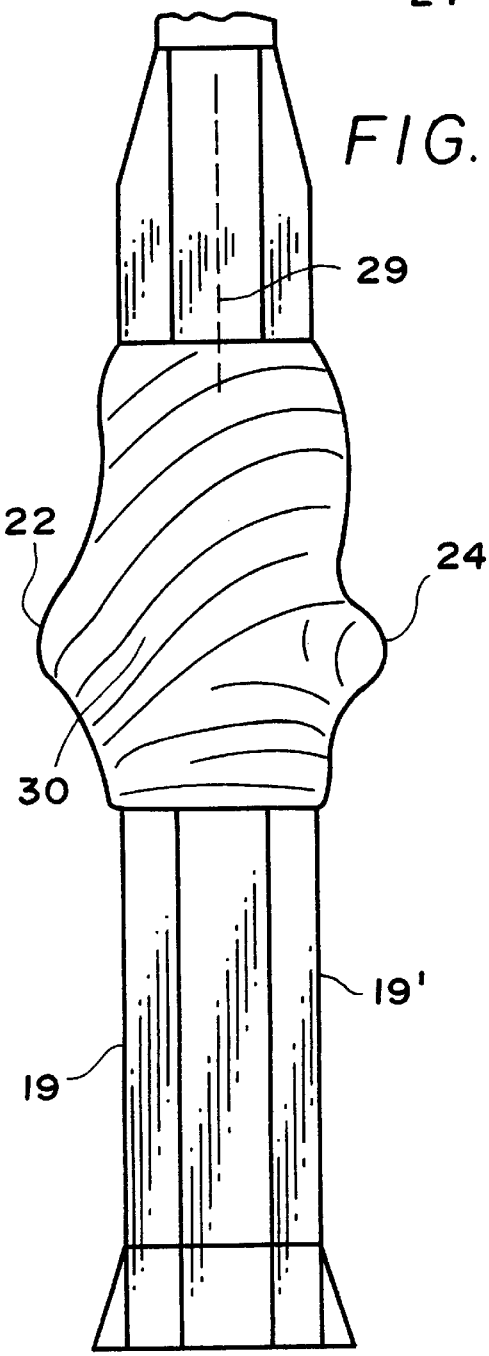
FIG. 8 is a right side view of the embodiment of FIG. 7 disclosing contours that form an offset bulge on the top surface of the handle and a trigger on the lower surface.
Figure 9:
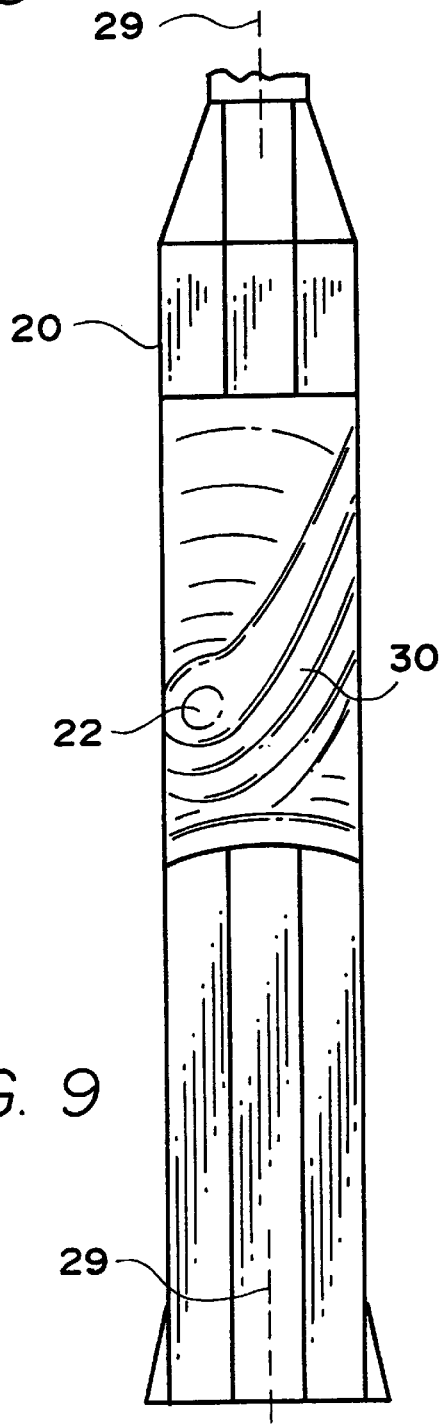
FIG. 9 is a top plan view of FIG. 8 showing the offset bulge with an angled surface to receive the base of lit the forefinger.

FIGS. 7, 8, and 9 disclose another embodiment wherein the bulge 22 is conveniently located to one side of the handle axis 29 and an angled planar surface 30, extending at a skewed angle to the axis 29, is formed. The surface 30 provides a natural surface for the base of the index finger when a continental grip is assumed and will act as a stop to limit hand rotation and/or correctly position the hand for backhand strokes. As seen in FIG. 7, which shows the side opposite of that shown in FIG. 8, an enlarged area 28 can be formed with a depression 26 in which a player's thumb is received.

Figure 10B:
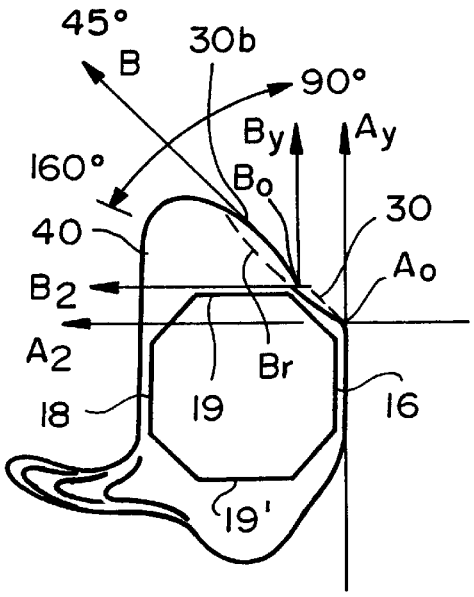
FIG. 10*b* is an end view similar to FIG. 10 showing a coordinate system for illustrating the hand cocking feature of the invention.
Figure 10:
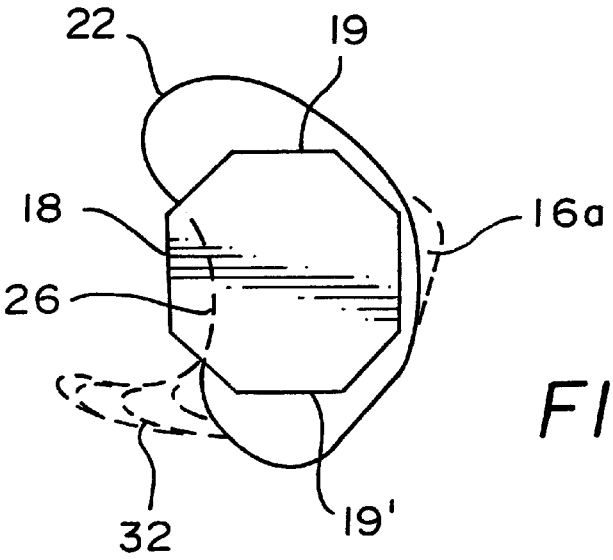
FIG. 10 is a diagrammatic end view of a racquet handle according to another embodiment of the invention showing a bulge extending outside the plane of the octagonal portion of the handle, a pronounced lip to receive the player's thumb, and a planar surface angled outwardly upon which the first knuckle of the index finger may rest.
Figure 10A:
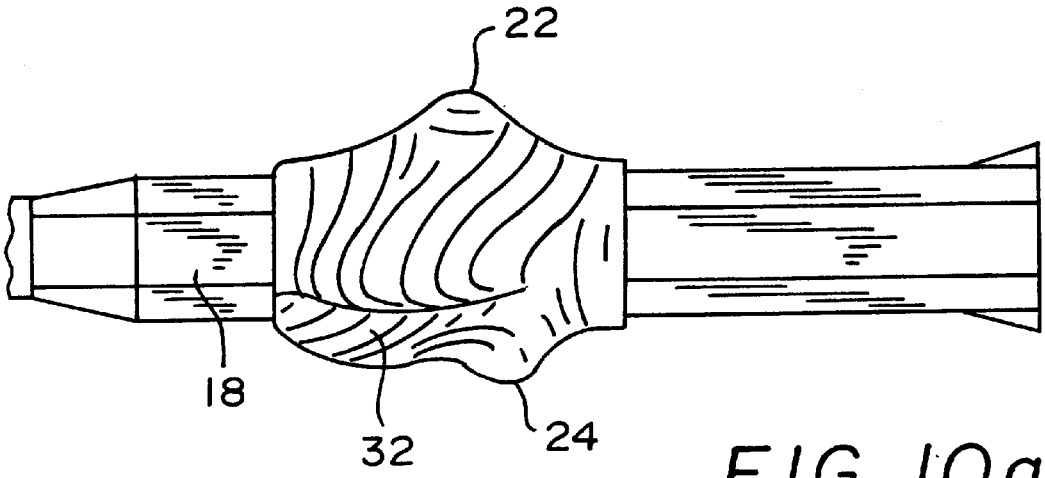
FIG. 10*a* is a left side elevation of the embodiment shown in FIG. 10.
Figure 11:
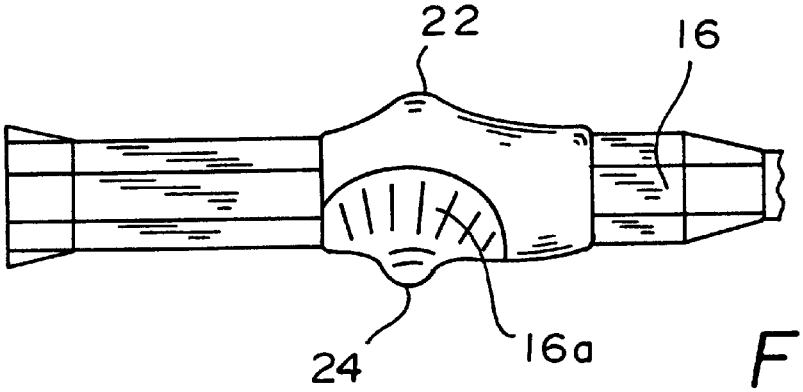
FIG. 11 is a right side view showing the outwardly angled planar surface of FIG. 10.

FIGS. 10 and 10*a* show an assembly configuration wherein the bulge 22 is angled rearwardly ("rearwardly" in the sense that the net or opposing court is located to the right as viewed in FIG. 10) with thumb depression 26 formed with an exaggerated lip 35. The multiple dotted lines show how this lip can be varied in size. Note that the depth of the depression 26 can vary widely depending on player preference. It may be very slight or so deep that its base extends below the side surface 18 of the octagonal handle. When such a configuration is used, the width of handle 20 is reduced in the area of the depression 26. Also, note in FIGS. 10 and 11 that an angled surface 16*a* is provided that angles outwardly. This surface will tilt the first knuckle of the index finger of a player toward a Western forehand position.

Figure 8A:
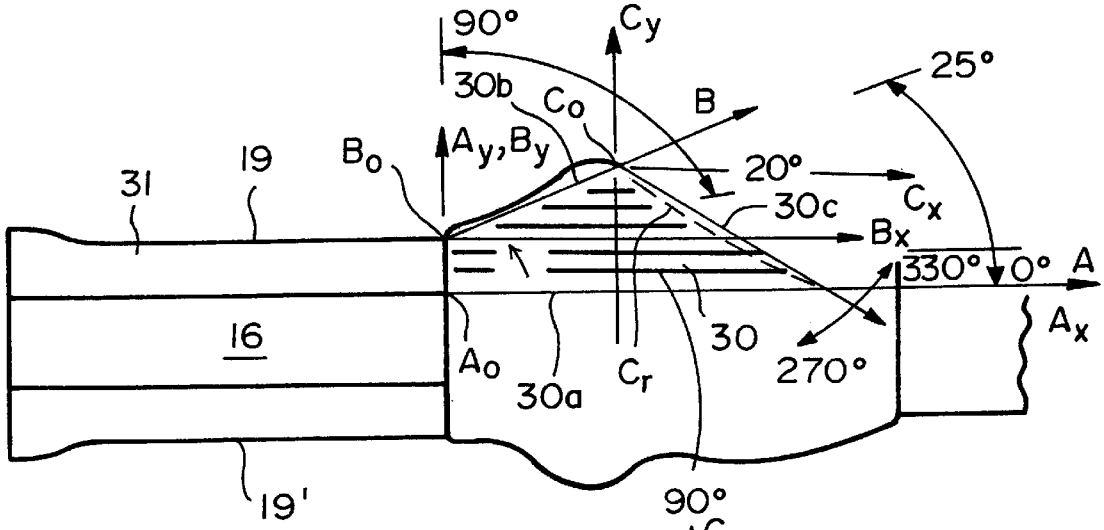
FIG. 8*a* is a right side view similar to FIG. 8 showing a coordinate system for illustrating a feature of the invention for cocking a player's hand.
Figure 9A:
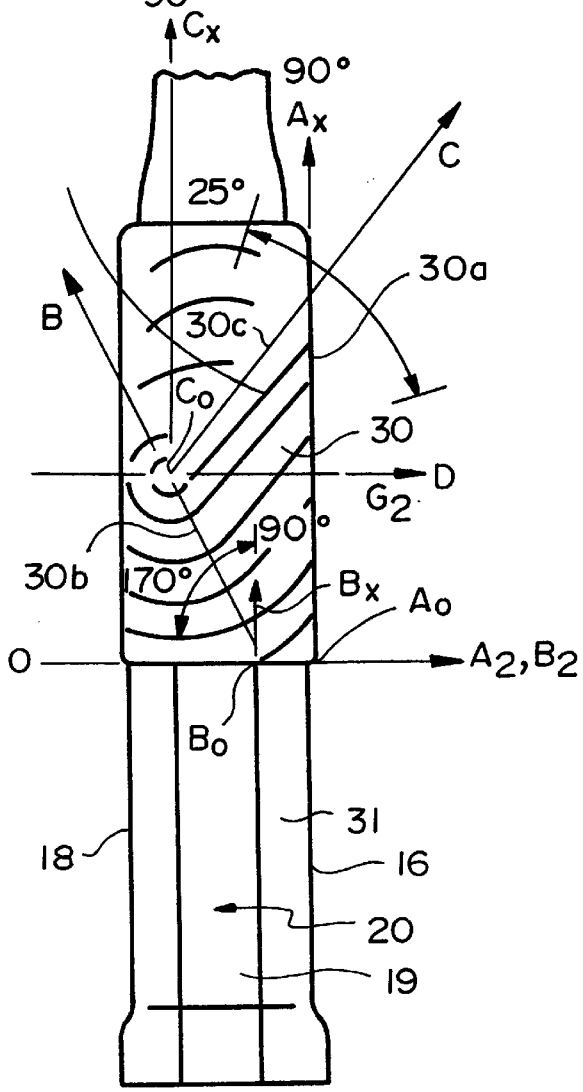
FIG. 9*a* is a top plan view similar to FIG. 9 showing a coordinate system for illustrating the hand cocking feature of the invention.

The orientation angle of surface 30 can be varied from the orientation shown in FIGS. 8, 9, and 10 to achieve a cocked hand position that some players prefer. FIGS. 8*a*, 9*a*, and 10*b* illustrate three orthogonal views of the surface 30 with coordinate systems superimposed thereon to show the geometry. FIG. 8*a* illustrates an X-Y plane view, FIG. 9*a* illustrates an Z-X plane view, and FIG. 10*b* illustrates a Z-Y plane view. There are three vectors of interest in defining the angle of surface 30 and its effect on hand position. A first vector A extends from an origin $A_o$ located at the uppermost end of the handle base portion 20*a* and at the intersection between the handle side surface 16 and a diagonal surface 31 extending between the side surface 16 and the top surface 19. Vector A extends from its origin along the top of the side surface 16 to define a first side 30*a* of the angled surface 30. A second vector B extends from an origin $B_o$ located at the uppermost end of the handle base portion 20*a* and at the intersection between the top surface 19 and the diagonal surface 31. Vector B 14 extends from its origin $B_o$ and intersects the highest point of the protrusion 22 to define a second side 30*b* of the surface 30. A third vector C extends from an origin CO located at the intersection of vector B and the highest point of the protrusion 22. Vector C then extends downwardly from its origin $C_o$ to intersect vector A, and defines a third side 30*c* of the surface 30.

The angle formed by the face of surface 30 can be changed by adjusting the direction of the vectors A, B, and C. As shown in FIG. 8*a*, vector A can be adjusted in the X-Y plane defined by axes $A_x$ and $A_y$ between a nominal angle of about 0° to an angle of about 25°. Upward adjustment of vector A in the X-Y plane tends to flatten the angled surface 30 so as to raise the player's forefinger and cock the hand back. This increases the player's wrist action and is useful for increasing service power.

As shown in FIGS. 8*a*, 9*a*, and 10*b*, the vector B can be adjusted in all three planes. As shown in FIG. 8*a*, vector B can be adjusted in the plane defined by axes $B_x$ and $B_y$ between about 20° and 90°. Upward adjustment of the angle of vector B in the X-Y plane tends to steepen the slope of the protuberance 22, which helps cock the hand back for power service. As shown in FIG. 9*a*, vector B can be adjusted in the plane defined by axes B, and B, between about 90° and 170°. Upward adjustment of the angle of vector B in the Z-X plane moves the protuberance 22 toward the rearward side 18 and the base end 25 of the handle, which again helps cock the player's hand back. As shown in FIG. 10*b*, vector B can be adjusted in the plane defined by axes $B_z$ and $B_y$ between about 90° and 160°. Upward adjustment of the angle of vector B in the Z-Y plane moves the protuberance 22 toward the rearward side 18 of the handle 20.

As shown in FIGS. 8*a* and 9*a*, vector C can be varied in the X-Y plane and the Z-X plane. As shown in FIG. 8*a*, vector C can be varied in the plane defines by axes $C_x$ and $C_y$ between about 270° and 330°. Upward adjustment of vector C in the X-Y plane flattens the surface 30 and increases cocking of the player's hand. As shown in FIG. 9*a*, vector C can be varied in the plane defined by axes $C_z$ and $C_x$ between about 20° and 70°. Upward adjustment of vector C in the Z-X plane tends to cock the player's wrist to the left (for right-handed players) by leftward rotation of the player's forefinger.

It will also be observed, in FIG. 10*b* in particular, that the angled surface 30 need not be planar. It may have a concave curvature with a positive radius of curvature or a convex curvature with a negative radius of curvature. FIG. 10*b* illustrates a radius of curvature Br taken along vector B. As shown in FIG. 8*a*, another radius of curvature Cr can be taken along vector C. As shown in FIG. 9*a*, different radii of curvature could be measured on angled surface 30 in any direction between vectors B and C, it being understood that surface 30 could have a complex compound curvature. Along any given vector extending from origin $C_o$, the curvature of surface 30 could range anywhere from infinity, for a planar surface, to as little as one inch or less, for a highly curved concave surface, to negative values for a concave surface.

Figure 12:
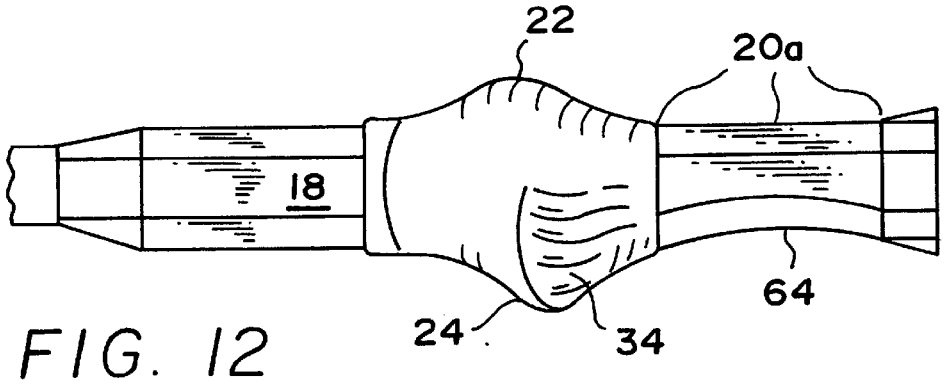
FIG. 12 is a side elevational view disclosing another embodiment of the invention in which there is a transverse thumb groove and also showing a reduced (concaved) periphery of the handle in the area of the grasping fingers.
Figure 12A:
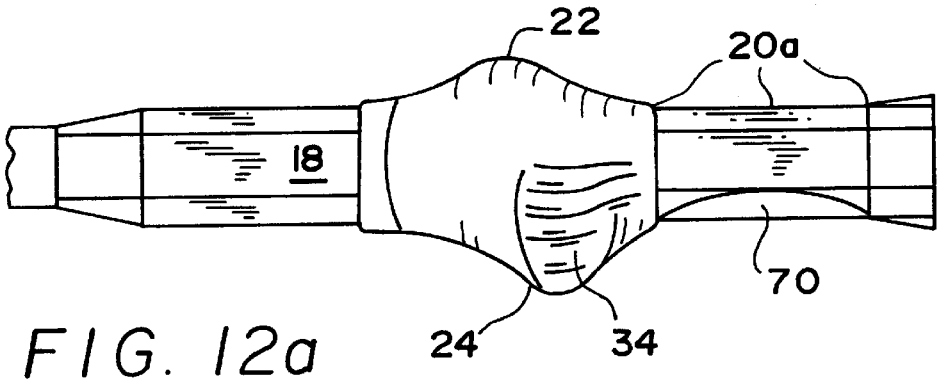
FIG. 12*a* is a view similar to FIG. 12 showing a transverse thumb groove and also showing a reduced (tapered) periphery of the handle in the area of the grasping fingers.
Figure 13:
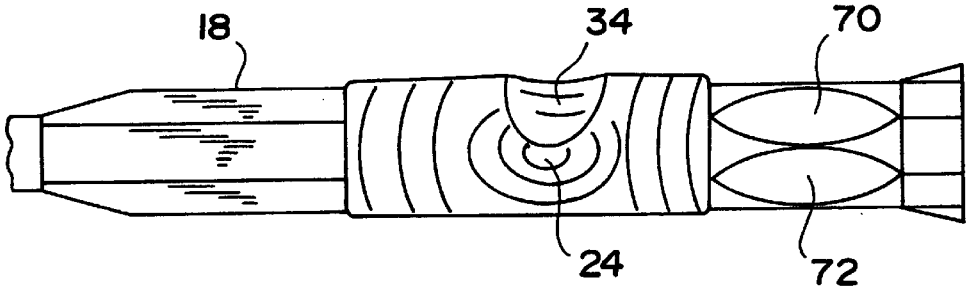
FIG. 13 is a bottom plan view of FIG. 12*a* showing how the transverse groove is partially formed in the trigger and disclosing structure for reducing the periphery of the handle base as disclosed in FIG. 12*a;*

Turning now to FIG. 12, the lower handle portion 20*a* of the racquet R next to the base 25 can be formed with a gentle arc 64 on the surface below the trigger 24. This provides a comfortable position (reduced periphery) for the three fingers which grasp that portion of the racquet, especially when a backhand grip is used. The concave surface formed by arc 64 can be used on all the embodiments described. This reduction in handle diameter can also be formed by shaving or otherwise reducing the ridged portions of the lower handle portion 20*a*, as shown by numerals 70 and 72 in FIGS. 12*a* and 13. As seen in those figures, tapering depressions 70 and 72 will provide a better grasp for some players by reducing the periphery of the handle in the area of the grasping fingers.

In the parent applications, the thumb-receiving surfaces or bowls are formed so that the thumb is fully supported while angularly disposed with respect to the axis of the handle. Some players prefer to have the thumb in a plane perpendicular or almost perpendicular to the axis of the handle to effect a Western backhand grip. An embodiment with this improvement is seen in FIGS. 12, 12*a*, 13, and 14. A groove 34 is formed transverse to the axis of the handle. Note in FIG. 13, in particular, this groove is partially formed in trigger 24. The thumb depression groove 34 does not interfere with the main functions of the trigger element.

Figure 14:
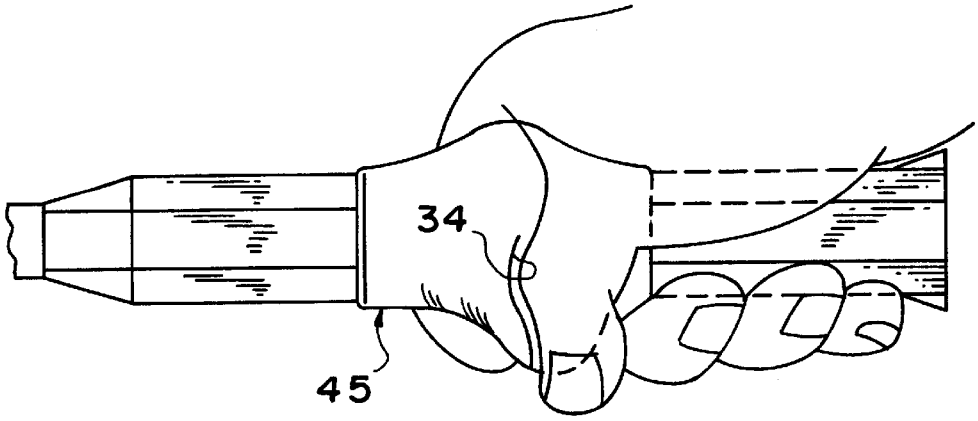
FIG. 14 is a side elevational view disclosing the embodiment of the invention in which there is a thumb groove transverse to the axis handle and also showing a player's hand and a handle without a lower handle concavity.

FIG. 14 shows the transverse thumb groove 34 without any concavity in the lower handle position 20*a*.

FIG. 15 is a side elevational view showing the thumb located in a transverse depression 37 depicted by a circle. The same player can use the oval depression 39 if that is more comfortable and advantageous. In all variations of the invention, a player can dispose his hand in certain but different positions. Also, the designs herein shown will strengthen many shots—for instance, the backhand—without interfering with a player's forehand and volley shots.

FIG. 16 is a side elevational view demonstrating two contoured areas on a handle 20. The first area 50, nearest the base 25 of the handle 20, is for the one hand, and a second area 52, placed farther up the handle 20 in the reverse direction, is to accommodate the other hand. This enables a two-handed player to take advantage of the contoured area configurations disclosed herein.

FIG. 17 is a side elevational view showing the angularly disposed planar surface 67. FIG. 18 is a cross-sectional view taken along line 18—18 in FIG. 17. The planar surface 67 is oriented at an angle to the plane of the racquet head. When gripped, this angularly disposed surface 67 will have a tendency to cause the user to tilt the racket head, making it easier to execute top spin backhands.

Although the foregoing configurations are believed to work best for most players, there may be some players who prefer handles with only some of the disclosed configuration elements. It will be understood, therefore, that each of the disclosed configuration elements could be used either alone or in combination with other configuration elements. For example, some players may prefer to use one or more thumb depressions in combination with one or more triggers, but not a bowl or protrusion for engaging the area between the thumb and forefinger. Still other players may find it 14 beneficial to combine one or more thumb depressions with a bowl or protrusion, but not a trigger. As previously stated, the depth of the one or more thumb depressions can vary depending on player preference.

The handle configurations taught herein and in the parent applications can be integrally formed on a racquet by molding or otherwise shaping the racquet material itself. For example, if the racquet has a wood frame, the handle can be formed by shaping the wooden stem portion of the racquet frame into one of the disclosed configurations. Modern day octagonal racquet handles, however, are usually formed as a tubular plastic sleeve mounted over an inner handle shaft of rectangular shape. It is contemplated that the disclosed handle configurations can also be formed as a tubular element slipped over the end of an existing handle structure.

The tubular element could replace the conventional octagonal handle or could be mounted over it. Alternatively, the tubular element could be mounted over other handle structures having other shapes. In each case, when a tubular construction is used, the interior configuration of the tube is preferably shaped to closely match the exterior configuration of the handle structure on which it is mounted. If the handle structure on which the tubular element is mounted is octagonal, which it would be if the tubular element is mounted over an existing octagonal handle, the interior surface is formed octagonally. If the handle structure on which the tubular element is mounted is rectangular, which it would be if the tubular element is added during initial racquet manufacture, or if the tubular element is added to an existing racquet after removing the original octagonal handle, the interior surface is formed rectangularly. If the interior of the tubular element does not conform exactly to the shape of the surface on which the element is mounted, it should at least fit snugly enough to prevent relative movement between the two structures.

It has been found that there are sometimes factors of economy and performance which can be obtained if the tubular element is molded separately of two different contoured pieces 44 and 46. The pieces can then be connected into a contoured assembly 45. This method will preserve the integrity of normal racquet production while permitting a great deal of tailoring for the hand of the particular player involved.

Figure 19A:
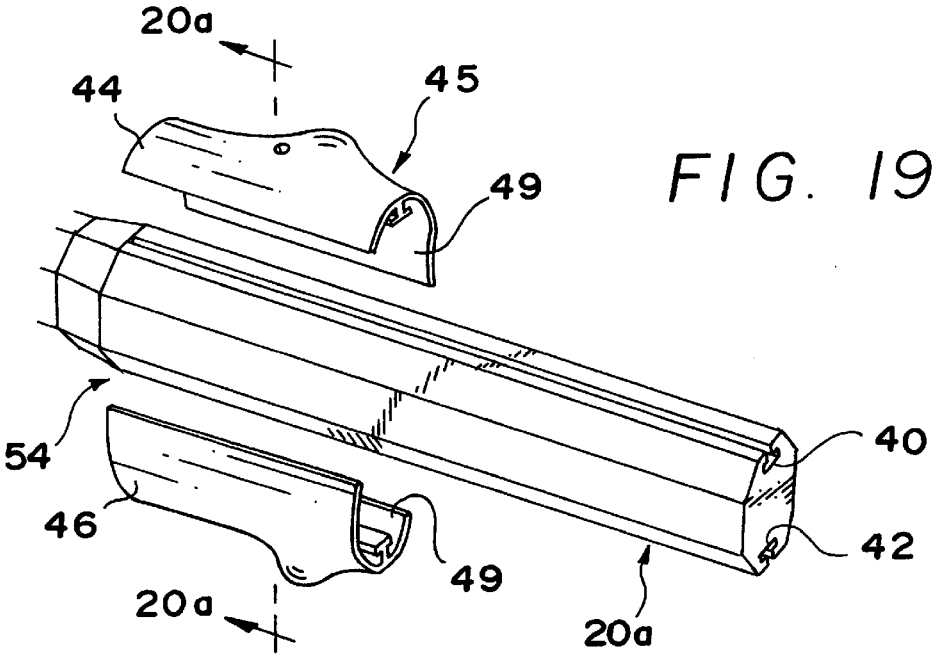
FIG. 19*a* is an exploded perspective showing a two-piece contour assembly in accordance with one method of implementing the invention.

In FIG. 19*a* there are a pair of contoured elements 44 and 46 that, when connected together, form an octagonal inner surface 49 to engage the octagonal periphery 54 of a handle structure in the form of the lower handle portion 20*a*.

Figure 21A:
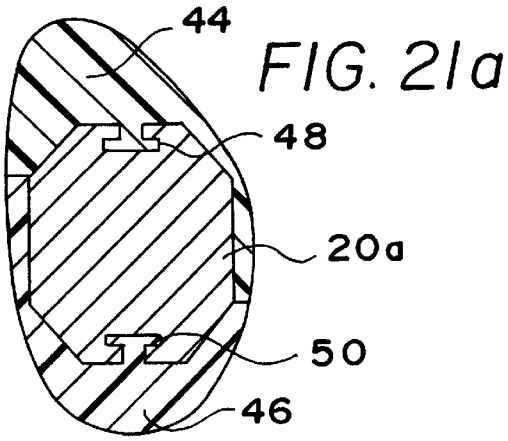
FIG. 21*a* is the cross section of FIG. 20*a* showing the contour elements formed as a contour assembly.
Figure 20A:
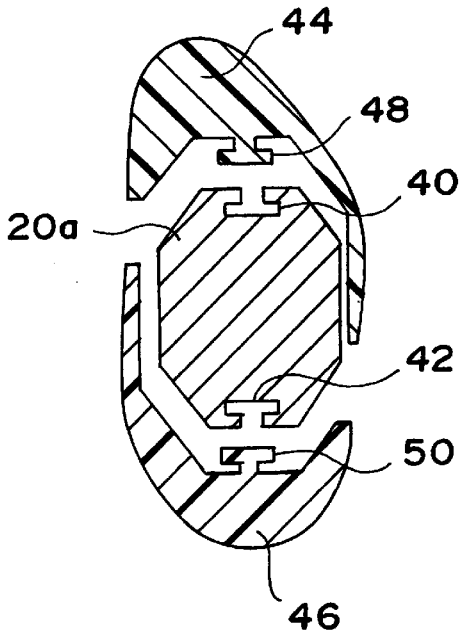
FIG. 20*a* is a cross section taken along line 20*a*—20*a* in FIG. 19*a* showing a pair of contour elements about to be assembled.

If desired, the elements 44 and 46 can be made to snap together around the handle portion 20*a*. Alternatively, as seen in FIG. 19*a*, the upper and lower surfaces of the handle portion 20*a* can be formed with T-shaped grooves 40 and 42 substantially throughout the length thereof. As shown in FIGS. 20*a* and 21*a*, the interior of elements 44 and 46 are formed with one or more T-shaped members or rails 48 and 50, respectively, for reception by these grooves. Extending downwardly from upper piece 44 is a T-shaped rail 48 adapted to be snugly received in a matching groove 40. Extending upwardly from lower piece 46 is a T-shaped rail 50 adapted to be snugly but slidably received in a groove 42. The assembly 45 can have the configurations molded according to any of the embodiments shown in this or in the parent applications.

Figure 22A:
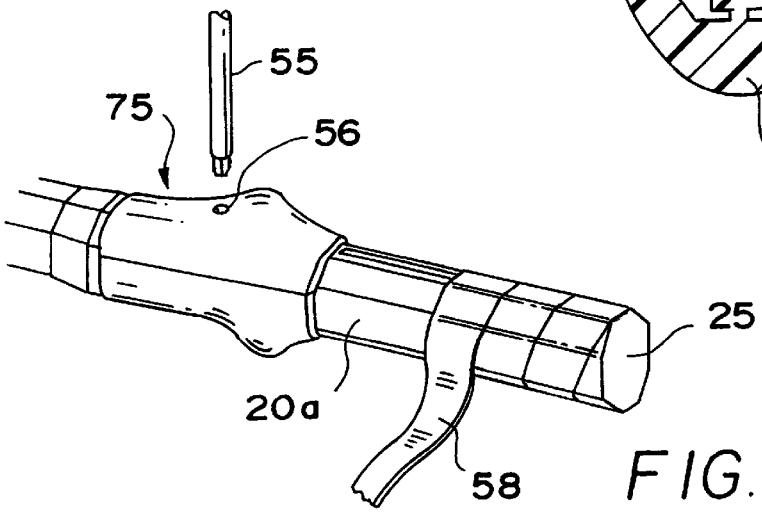
FIG. 22*a* is a perspective of a handle in accordance with FIG. 19*a* during the final stages of assembly.

As seen from FIG. 22*a*, a tubular element 75 is made either as a unitary sleeve or formed from the two contoured elements 44 and 46 connected together as the contour assembly 45. The tubular element 75 can be moved axially along the lower handle portion 20*a* to a selected location where the tubular element can be affixed to the handle by way of a screw 55 or the like. The upper side of the tubular element 75 is formed with an aperture 56 to receive the screw 55.

After securement of the tubular element 75, the remainder of the lower handle portion 20*a* is then wrapped by a conventional strap 58 (usually leather) in known fashion from the base 25 up to the tubular element 75. The strap is secured and bonded to the handle in the normal fashion.

In FIG. 19*b* there are a pair of contoured elements 44 and 46 that, when connected together, form a rectangular inner surface 49 to engage the rectangular periphery 54 of a handle structure in the form of a handle inner shaft 20*b*.

If desired, the elements 44 and 46 can be made to snap together around the handle inner shaft 20*b*. Alternatively, as seen in FIG. 19*b*, the upper and lower surfaces of the handle inner shaft 20*b* can be formed with T-shaped grooves 40 and 42 substantially throughout the length of the handle inner shaft. As shown in FIGS. 20*b* and 21*b*, the interior of elements 44 and 46 are formed with two T-shaped members or rails 48 and 50, respectively, for reception by these grooves. Thus, extending downwardly from upper piece 44 are two T-shaped rails 48 adapted to be snugly received in a matching groove 40. Extending inwardly and upwardly from lower piece 46 are two T-shaped rails 50 adapted to be it snugly but slidably received in a groove 42. Enlarged openings 60 along the grooves 40 and 42 are sized to receive the flanged portions of the T-shaped rails 48 and 50, and will facilitate mounting the pieces 44 and 46 to the handle inner shaft 20*b*. The assembly 45 can have the configurations molded according to any of the embodiments shown in this or in the parent applications.

FIG. 21*b* shows an exterior covering 74 over contoured elements 44 and 46. The covering 74 is made of a cushioning material which adds to comfort and shock absorption.

As seen from FIG. 22*b*, a tubular element 75 is made either as a unitary sleeve or formed from the two contoured elements 44 and 46 connected together as the contour assembly 45. The tubular element 75 which can be moved axially along the handle inner shaft 20*b* to a selected location where the tubular element can be affixed to the handle by way of a screw 55 or the like. The upper side of the tubular element 75 is formed with an aperture 56 to receive the screw 55.

After securement of the tubular element 75, the lower handle portion 20*a*, formed by a conventional octagonal sleeve, is mounted on the handle inner shaft 20*b*. The lower handle portion 20*a* is then wrapped by a conventional strap 58 (usually leather) in known fashion from the base 25 up to the tubular element 75. The strap is secured and bonded to the handle in the normal fashion. If a gap remains between the tubular element 75 and the lower handle portion 20*a*, a filler or filler rings 76 can be inserted before wrapping with the strap 58. As shown in FIGS. 23 and 24, the fillers or rings 76 are either friction-fitted or snapped or glued to the handle inner shaft 20*b* prior to wrapping with strap 58. The fillers 76 provide a smooth transition between the tubular element 75 and the lower handle portion 20*a*. They can also be used in the two-handed embodiment of FIG. 16 between the contour areas 50 and 52 to adjust the spacing thereof.

The grooves 40 and 42 need not run the entire length of the handle inner shaft 20*b* if shorter grooves are desired. If shorter grooves are desired, a modification of the T-shaped grooves is made. In the event the tubular element 75 is molded in one piece, the grooves will be formed so as to extend to the lower end of the handle inner shaft 20*b*.

It should be understood that certain commercial adhesives can be used to secure pieces together during assembly. For instance, the engaging of contoured elements 44 and 46 can be secured by an adhesive. The same is true for fillers 76 and 77.

Although the means for securing and locating the tubular element 75 along the length of the handle inner shaft 20*b* is described with respect to a particular contoured assembly, it should be understood that such location means can be used for all embodiments as well as the two-handed embodiment.

Figure 25:
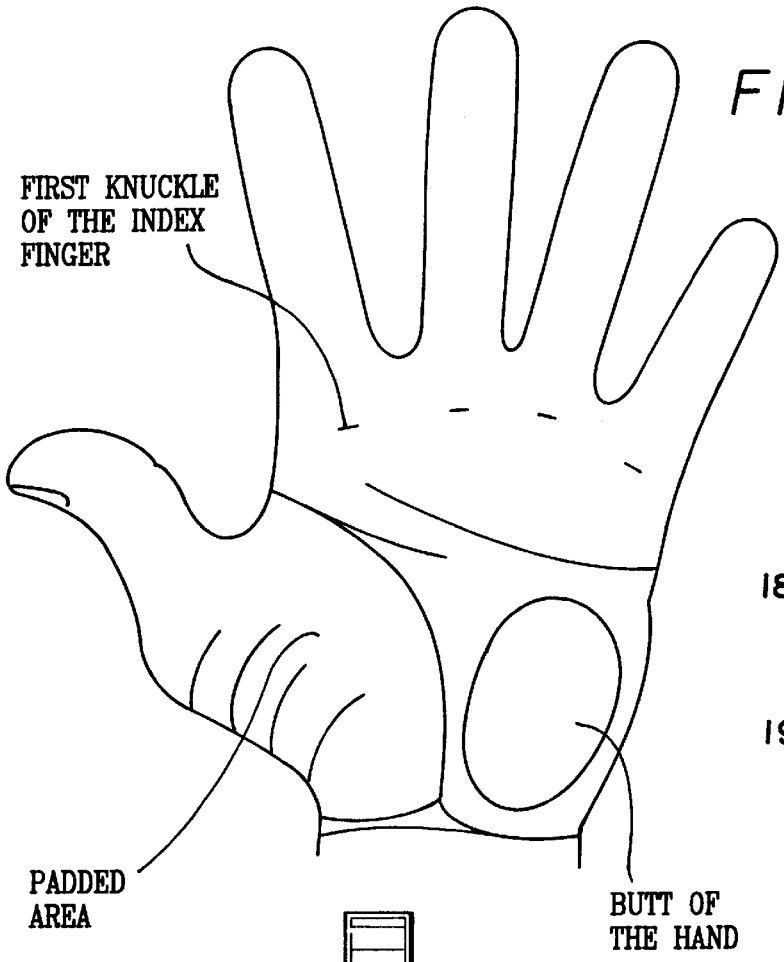
FIG. 25 is a diagrammatic plan view of a player's left hand, which for right handed players would be the secondary playing hand used for two-handed backhand strokes.

Referring now to FIG. 25 for nomenclature purposes, the left hand of a tennis player is shown, which in the case of right handed players, is a secondary hand used for two handed backhand strokes. The index finger, thumb, and the padded saddle area at the base of the thumb contribute guidance, control and power to the player during back hand strokes. The third, fourth, and fifth fingers provide much of the grasping power.

Figure 26:
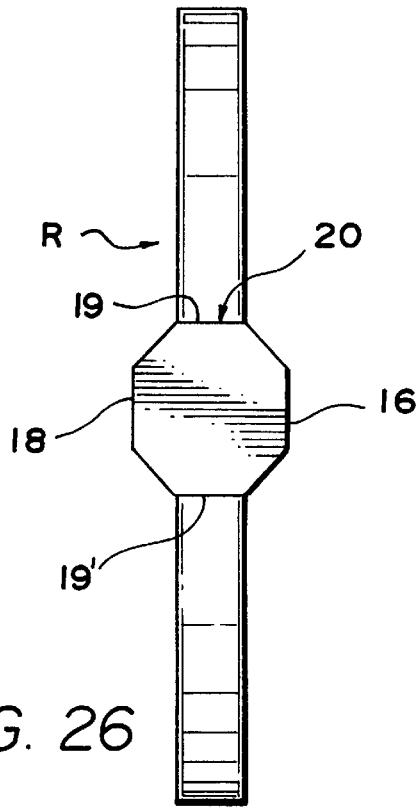
FIG. 26 is an end view of a racket handle showing its orientation relative to a racket head.
Figure 27:
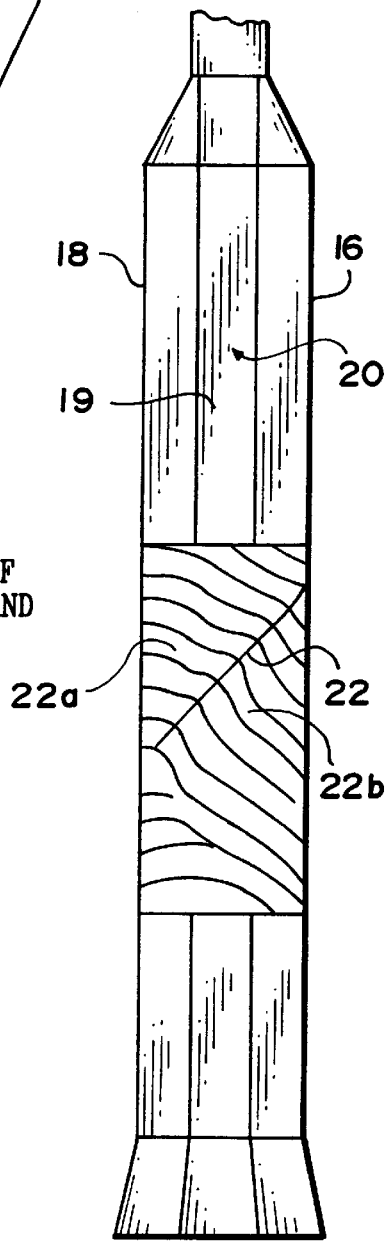
FIG. 27 is a top plan view showing another embodiment of the invention.
Figure 28:
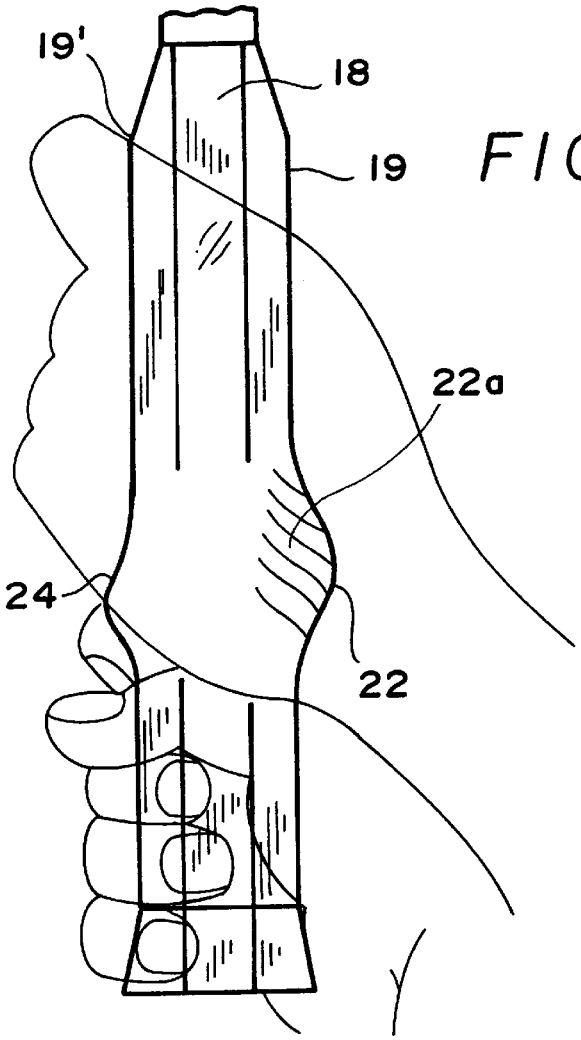
FIG. 28 is a side elevation view showing a two-handed backhand grip using the embodiment of FIG. 27.

Referring now to FIG. 26, wherein like numerals indicate like parts previously shown and described in prior figures, the numeral 20 indicates an octagonal tennis racquet handle of the racquet R. The tennis racquet handle 20 includes side surfaces 16 and 18. The top surface of the octagonal portion of the handle is indicated by the numeral 19 and the bottom surface by the numeral 19'.

In the preceding embodiments, a contour area comprising a protrusion 22 and a trigger 24 have been disclosed. The protrusion 22 provides a surface against which the saddle formed by the index finger and the thumb of the player's principal playing hand can be placed. This engagement locates the principal playing hand and/or acts as a pivotal point when changing from forehand to backhand grips and vice versa. The trigger 24 supports the index finger of the principal playing hand for added control and for increasing the player's awareness of his or her principal playing hand along the length of the handle.

Figure 29:
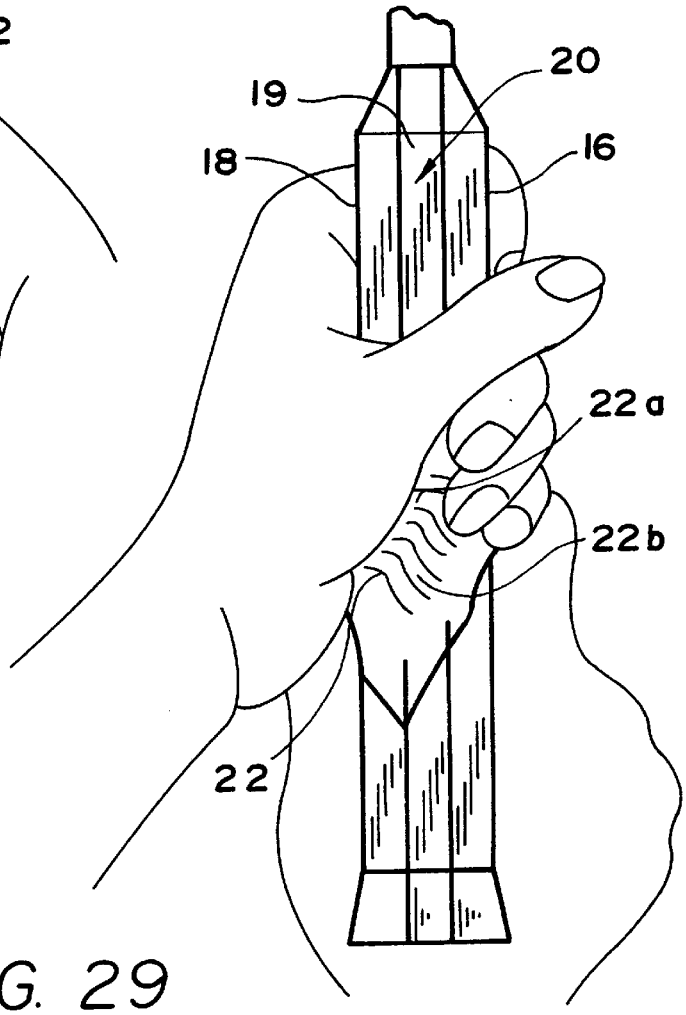
FIG. 29 is a top plan view showing the placement of a secondary playing hand using the embodiment of FIG. 27.
Figure 30:
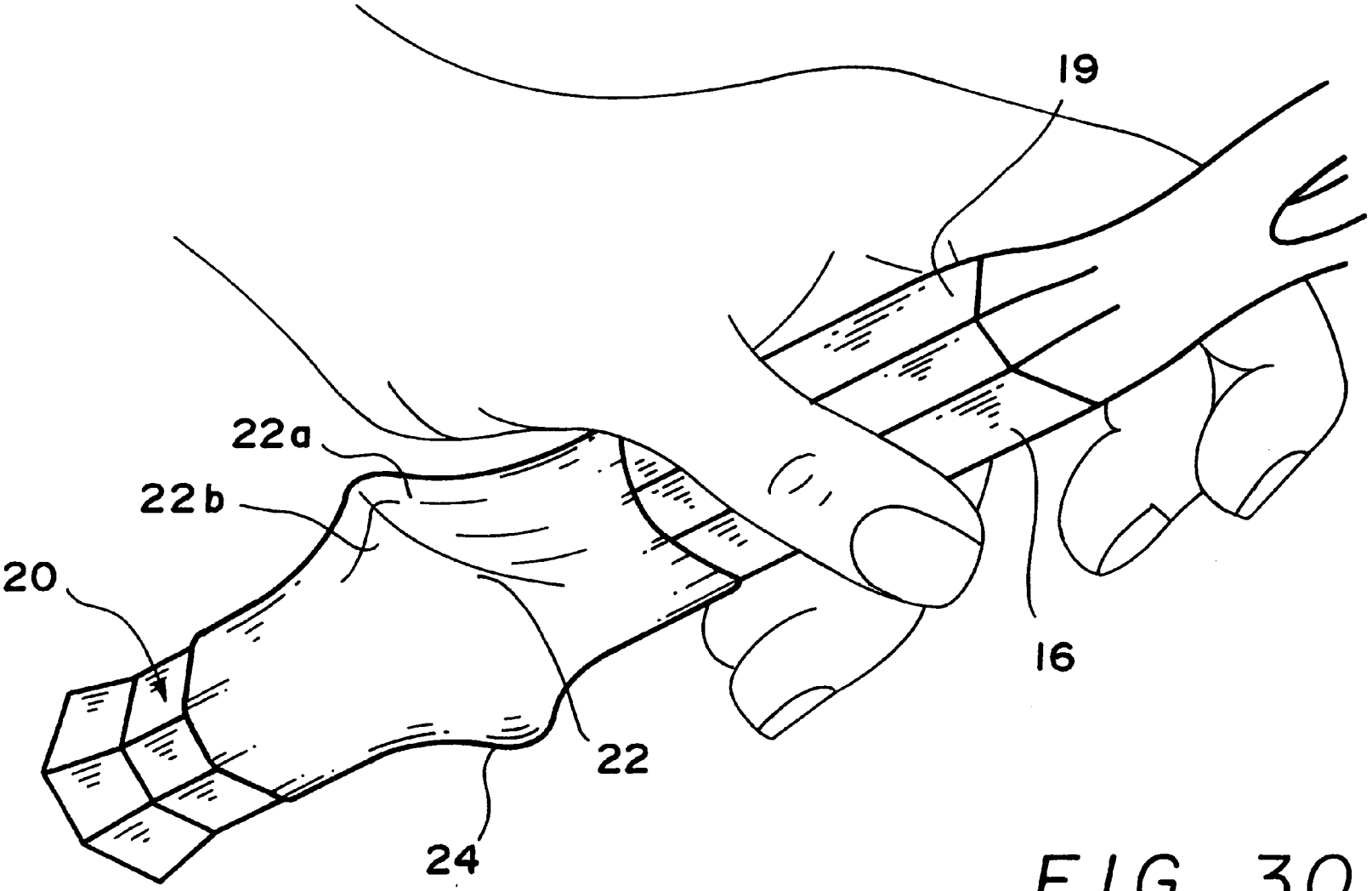
FIG. 30 is perspective view showing the placement of a secondary playing hand using the embodiment of FIG. 27.

As shown in FIGS. 27–30, a single contour area can be constructed for two-handed backhand play by modifying the protrusion 22. In this embodiment the protrusion 22 still receives the area between the thumb and forefinger of the principal playing hand, and the trigger 24 still receives the index finger of the principal playing hand. However, the contour area is adapted to accommodate the secondary playing hand by forming an angled depression 22*a* in the racket head side of the protrusion 22 to receive the padded area at the base of the thumb of the secondary playing hand. The base side 22*b* of the protrusion 22 remains the same as in previous embodiments. The angle of the concavity 22*a* is such that the concavity extends longitudinally from a first end located closest to the base of the handle 20 to a second end located closest to the racket head. Laterally, the concavity 22*a* preferably also extends from the upper edge of the side surface 18 and across the upper surface 19. If desired, the concavity 22*a* can also be extended laterally to the upper edge of the side surface 16. As shown in FIG. 29, the concavity 22*a* is preferably aligned along the line generally formed by the thumb of the secondary playing hand as it wraps around the handle 20. The concavity 22*a* allows the secondary playing hand to be positioned closely adjacent to the principal playing hand for increased power and control during two-handed backhand strokes.

Figure 31:
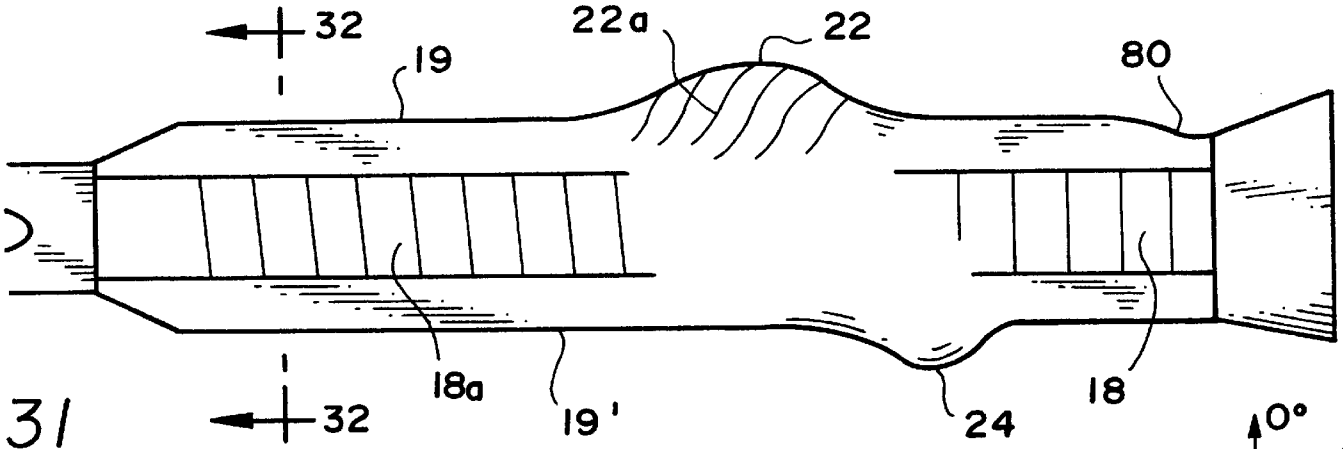
FIG. 31 a side elevation view showing another embodiment of the invention.
Figure 32:
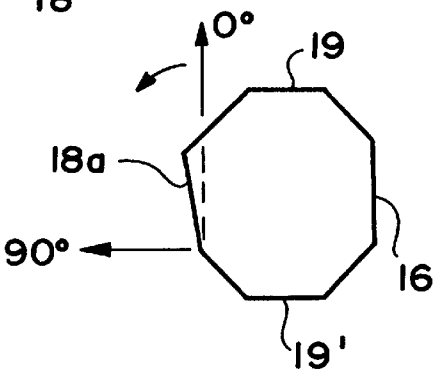
FIG. 32 is a cross-section of FIG. 31 showing an angled side surface to receive the first knuckle of the index finger of a secondary playing hand.

Referring now to FIGS. 31 and 32, it will be seen that the side 18 of the handle 20 can be downwardly angled at the racket head end thereof to form a downwardly angled surface 18*a* that receives the first knuckle of the index finger of the secondary playing hand. This provides a slight Western grip for two-handed backhand strokes. As further shown in FIG. 31, a concavity 80 can be provided in the upper side 19 of the handle 20 to receive the butt of the principal playing hand. The concavity 80 brings the grasping fingers closer together and provides for a better grip on the handle 20. FIG. 31 further shows that the trigger 24 can be positioned toward the base end of the handle 20 relative to the protrusion 22. This configuration can be used so that the thumb of the principal playing hand can engage the trigger 24 during backhand strokes.

Figure 33:
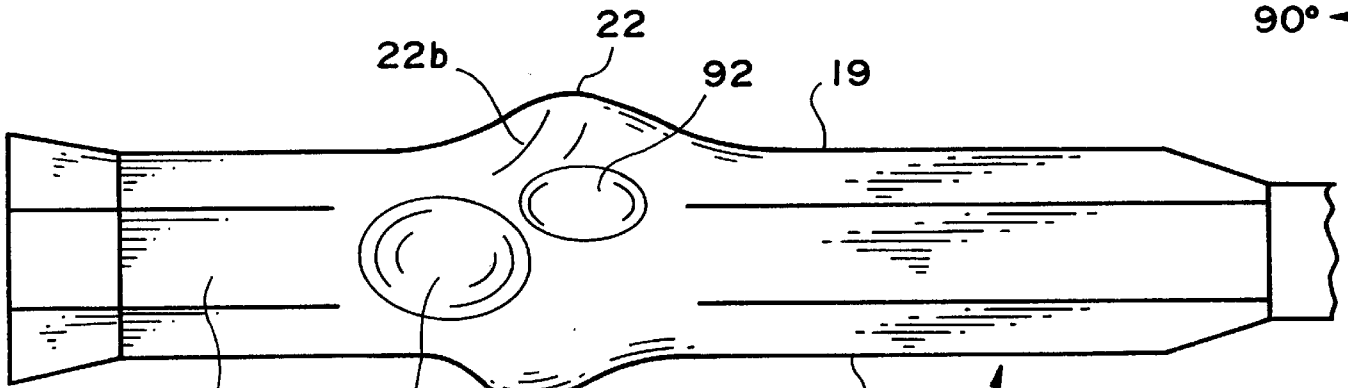
FIG. 33 is a side elevation view showing another embodiment of the invention.

Referring now to FIG. 33, another contour configuration is shown in which one or more indentations 90 and 92 are formed on the net side of the handle 20. The indentations 90 and 92 receive the first knuckle of the index finger of the principal playing hand. The indentation 90 is formed in the side surface 16 of the handle 20 and is useful for forehand strokes. The indentation 92 is formed on or slightly below the surface 22*b* of the protrusion 22 and is useful for serves and volleys.

Figure 35:
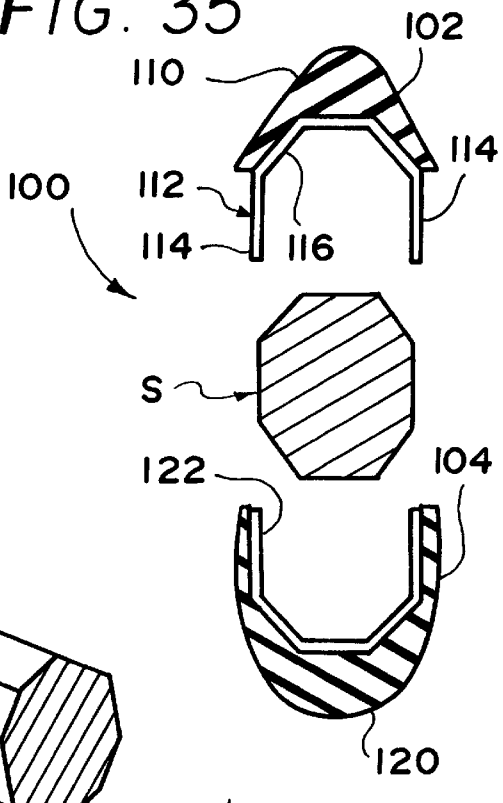
FIG. 35 is a cross section of FIG. 34.
Figure 34:
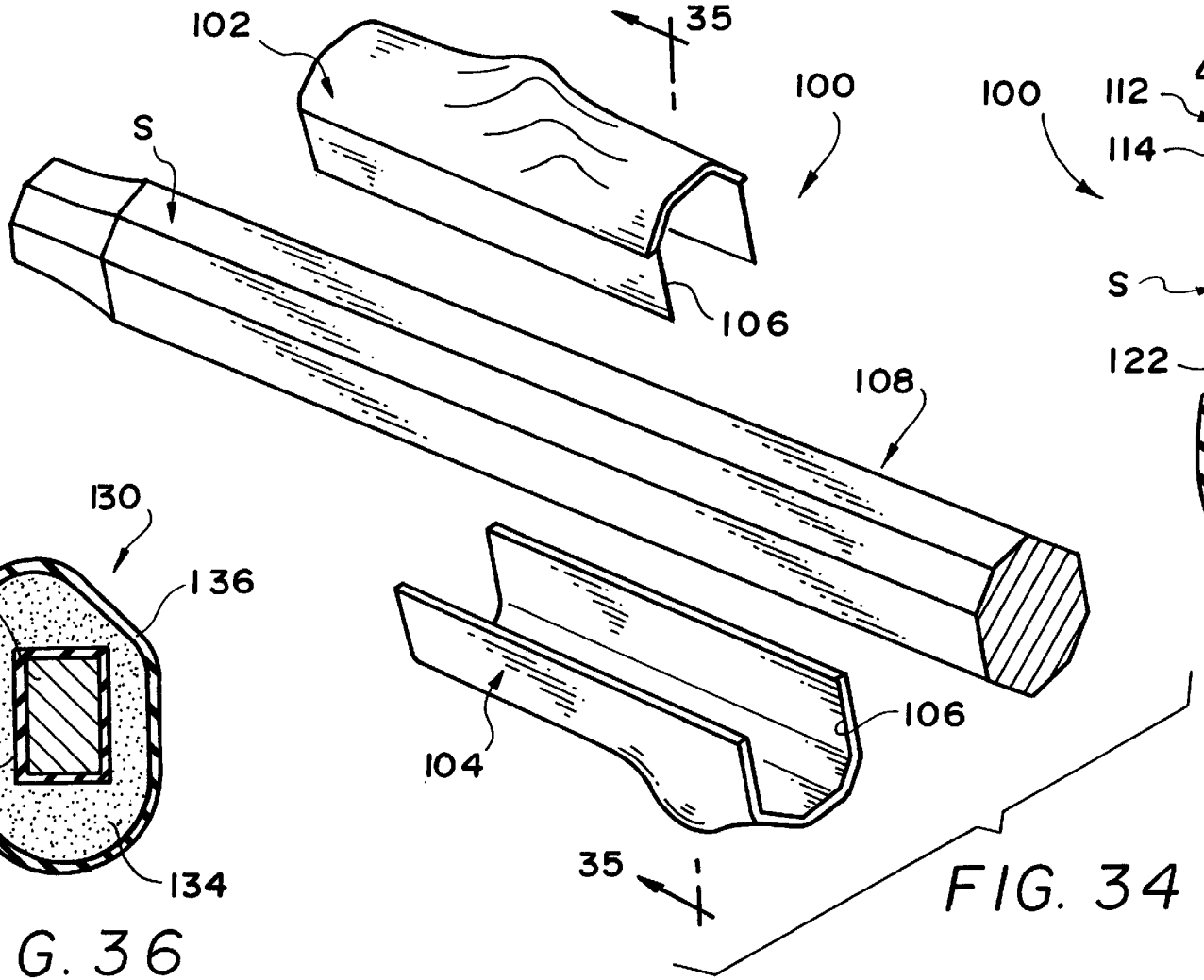
FIG. 34 is an exploded perspective showing a two-piece contour assembly in accordance with another method of implementing the invention.

Referring now to FIGS. 34 and 35, a contour assembly 100 is shown for use in accordance with a useful handle construction method. In FIG. 35 there are a pair of contoured elements 102 and 104 that, when connected together, form an octagonal inner surface 106 to engage the octagonal periphery 108 of a handle shaft S.

The contoured element 102 includes a shaped outer portion 110 made from a suitable semi-soft cushioning material, such as neoprene rubber. The exterior surface of the outer portion 110 is contoured to define an upper portion of one of the contour shapes disclosed above. An inner sheet portion 112 of the contoured element 102 is affixed to, or made integral with, the inner side of the outer portion 110. The inner sheet portion 112 defines a pair of side flaps 114 extending below the outer portion 110. The inner portion 112 can be made from any suitably strong sheet material. An adhesive layer 116 is applied to the inside of the inner portion 112 and the inner portion 112 is made to wrap around and bond to the sides of the handle shaft S. Alternatively, a removable connection could be provided between the contoured element 102 and the handle S.

The contoured element 104 is formed from a shaped outer portion 120 made from a suitable semi-soft cushioning material, such as neoprene rubber. The exterior surface of the outer portion 120 is contoured to define the side and lower portions of one of the contour shapes disclosed above. An adhesive layer 122 is applied to the inner surface of the outer portion 120 and is made to wrap around and bond to the handle shaft S and the side flaps 114 of the inner portion 112 of the contour element 102. Alternatively, a removable connection could be provided between the contoured element 104 and the handle shaft S.

Thus, an integral assembly 100 is formed to define a contour area of a racket. The assembly 100 can have a configuration molded according to any of the embodiments shown in this or in the parent applications.

Figure 36:
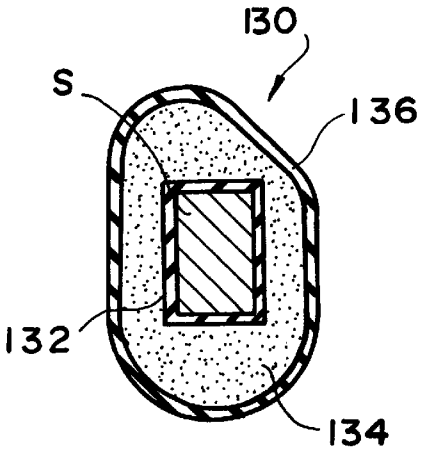
FIG. 36 is a cross section showing a one piece molded contour assembly in accordance with another method of implementing the invention.

Referring now to FIG. 36, a unitary molded handle sleeve element 130 is shown. The sleeve 130 is formed over a handle shaft S. It includes a stiff inner frame 132 made from a material such as plastic or aluminum. The inner frame 132 is affixed to the handle shaft S using any suitable means, such as adhesive bonding, or perhaps a removable connection. An intermediate layer 134 is formed, preferably by molding, over the inner frame 132 and is made from a light weight material such as polymeric foam, e.g., expandable polystyrene, expandable polypropylene, or the like. The intermediate layer 134 is configured to define one of the handle contour shapes disclosed above. The intermediate layer 134 is covered, preferably by molding, by an exterior layer 136 made from a semi-soft material such as neoprene rubber. Advantageously, the light weight of the intermediate layer 134 reduces handle weight and thereby increases player comfort and racket control.

Figure 37:
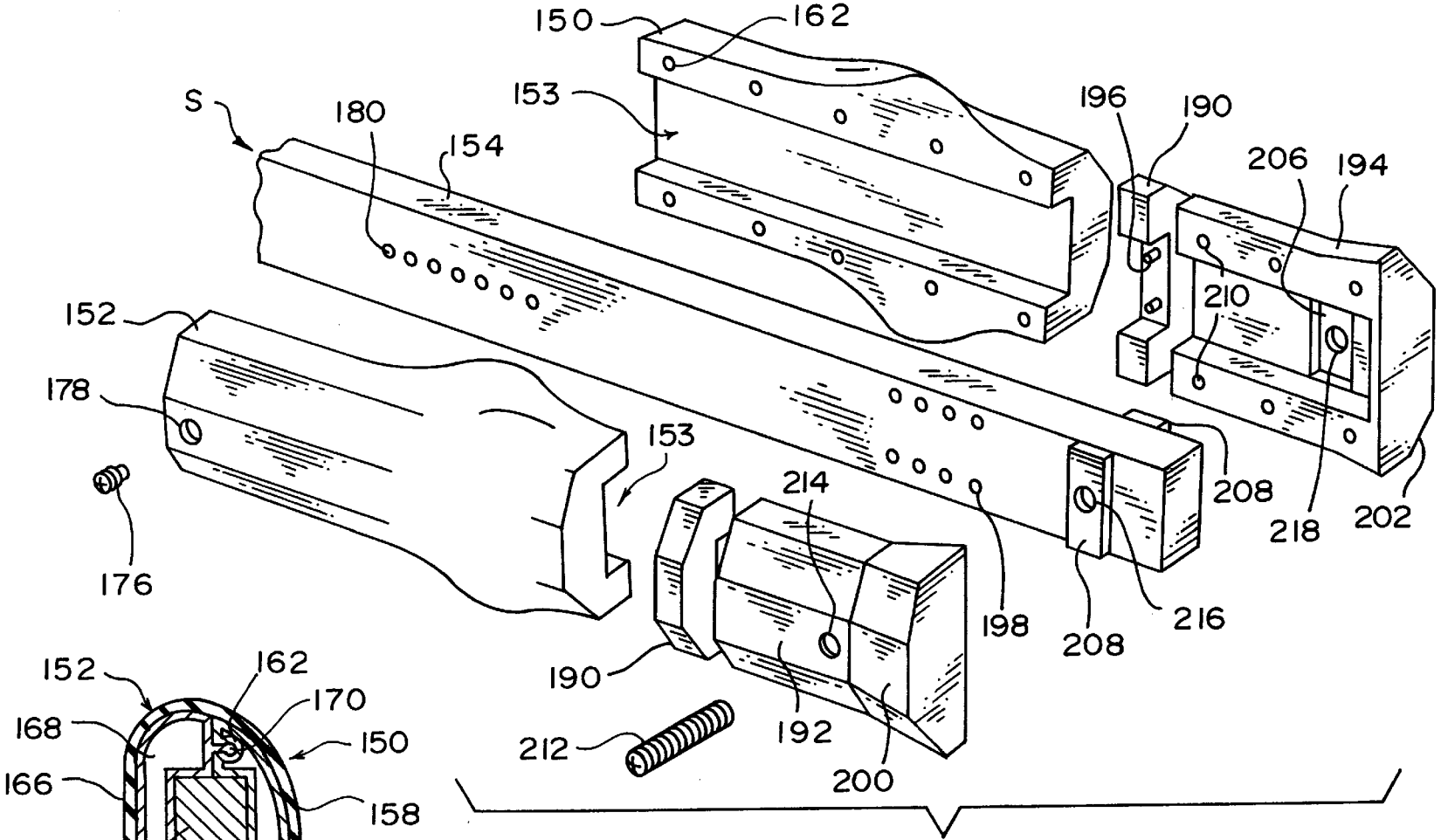
FIG. 37 is an exploded perspective showing a two-piece contour assembly in accordance with another method of implementing the invention.

Referring now to FIG. 37, there are a pair of contoured elements 150 and 152 that, when connected together, form a rectangular inner surface 153 to engage the rectangular periphery 154 of a handle shaft structure S. The handle shaft S is conventional in nature and can be made from wood, metal, composite plastic or any other suitable material.

Figure 38:
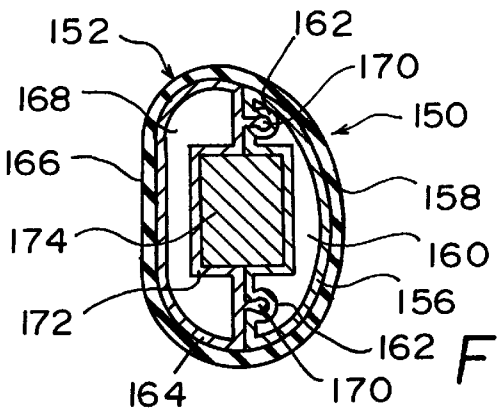
FIG. 38 is a cross section of FIG. 37.

As shown in FIG. 38, each of the contoured elements 150 and 152 have hollow interiors so as to reduce handle weight. The contoured element 150 includes a frame 156 that is preferably made from molded plastic or aluminum, or any other suitable lightweight material. The frame 156 is covered by an exterior layer 158 of a semi-soft material such as neoprene rubber. The frame 156 forms an interior air space 160 that reduces the weight of the element 150. As also shown in FIG. 37, the frame 156 is further formed with upper and lower arrays of snap holes 162 for attaching the element 150 to the element 152.

The contoured element 152 includes a frame 164 that is preferably made from molded plastic or aluminum, or any other suitable lightweight material. The frame 164 is covered by an exterior layer 166 of a semi-soft material such as neoprene rubber. The frame 164 forms an interior air space 168 that reduces the weight of the element 152. The frame 164 is further formed with upper and lower arrays of snaps 170 for attaching the element 152 to the element 150.

The contour elements 150 and 152 are thus preferably made to snap together around the handle shaft S. To achieve further weight savings, the handle shaft itself can be made from a frame 172 made from any suitably strong lightweight material that defines an interior air space 174.

As further shown in FIG. 37, the assembly formed by the contour elements 150 and 152 can be selectively positioned on the handle shaft S using a set screw 176 that extends through a hole 178 in the contour element 152 and threads into one of a plurality of holes 180 formed in the handle shaft S. Alternatively, the set screw 176 could extend through the holes 180 in the handle shaft and thread into one of a plurality of holes (not shown) in the contour element 150. The contour elements 150 and 152 can be mounted on the shaft S at selected locations depending on which of the holes 180 is used to receive the set screw 176.

After securement of the contour elements 150 and 152 using the screw 176, the remainder of the handle can be formed using one or more pairs of gap filler pieces 190 and a pair of handle base elements 192 and 194.

The gap filler pieces 190, which are made from plastic, metal or any other suitable material, are configured to mount to the handle shaft S immediately adjacent the base end of the contour elements 150 and 152. Like the contour elements 150 and 152, the gap filler pieces 190 may have hollow interiors and exteriors coated with a semi-soft material such as neoprene rubber. The gap filler pieces 190 preferably have a conventional octagonal exterior shape. The interiors of the gap filler pieces are U-shaped in order to receive the rectangular shaft S. Each gap filler piece has a pair of snaps 196 formed on an inner side surface thereof. The snaps 196 releasably engage snap holes 198 formed in the sides of the handle shaft S at locations where the gap filler pieces are to be mounted.

The handle base elements 192 and 194, which are made of plastic, metal or any other suitable material, have an octagonal exterior surface and a U-shaped interior surface, much like the gap filler pieces 190. The exterior surface may be coated with a semi-soft material such as neoprene rubber. The handle base elements 192 and 194 are substantially longer than the gap filler pieces 190 and have flared base portions 200 and 202, respectively. In addition, an interior surface of each of the handle base elements 192 and 194 has a recess 206 that engages a bar stop member 208 formed on each side of the shaft S. The bar stop members 208 help maintain the handle base elements in position on the shaft S and prevent them from moving toward the base end thereof. The handle base elements 192 and 194 attach to the shaft S in similar fashion to the contour elements 159 and 152. The handle base element 194 has two rows of snap holes 210 formed on two interior surfaces thereof that mate with corresponding interior surfaces on the handle base element 192. Corresponding snaps (not shown) are formed on the two opposing interior surfaces of the handle base element 192. When the handle base elements 192 and 194 are snapped together, they form a single assembly having a conventional octagonal handle shape. To help secure the handle base elements 192 and 194 to the shaft S, a set screw 212 is mounted so as to extend through a hole 214 formed in the handle base element 192, a hole 216 formed in the shaft S, and into a threaded hole 218 formed in the handle base element 194.

After assembly on the shaft S, the contour elements 150 and 152, the gap fillers pieces 190, and the handle base elements 192 and 194, can be wrapped by a conventional strap (usually leather) in known fashion. The strap is secured and bonded to the handle in the normal fashion. Alternatively, if a neoprene rubber or the like is coated on the outside of the aforementioned elements, it may be desirable to forego the strap.

Figure 39:
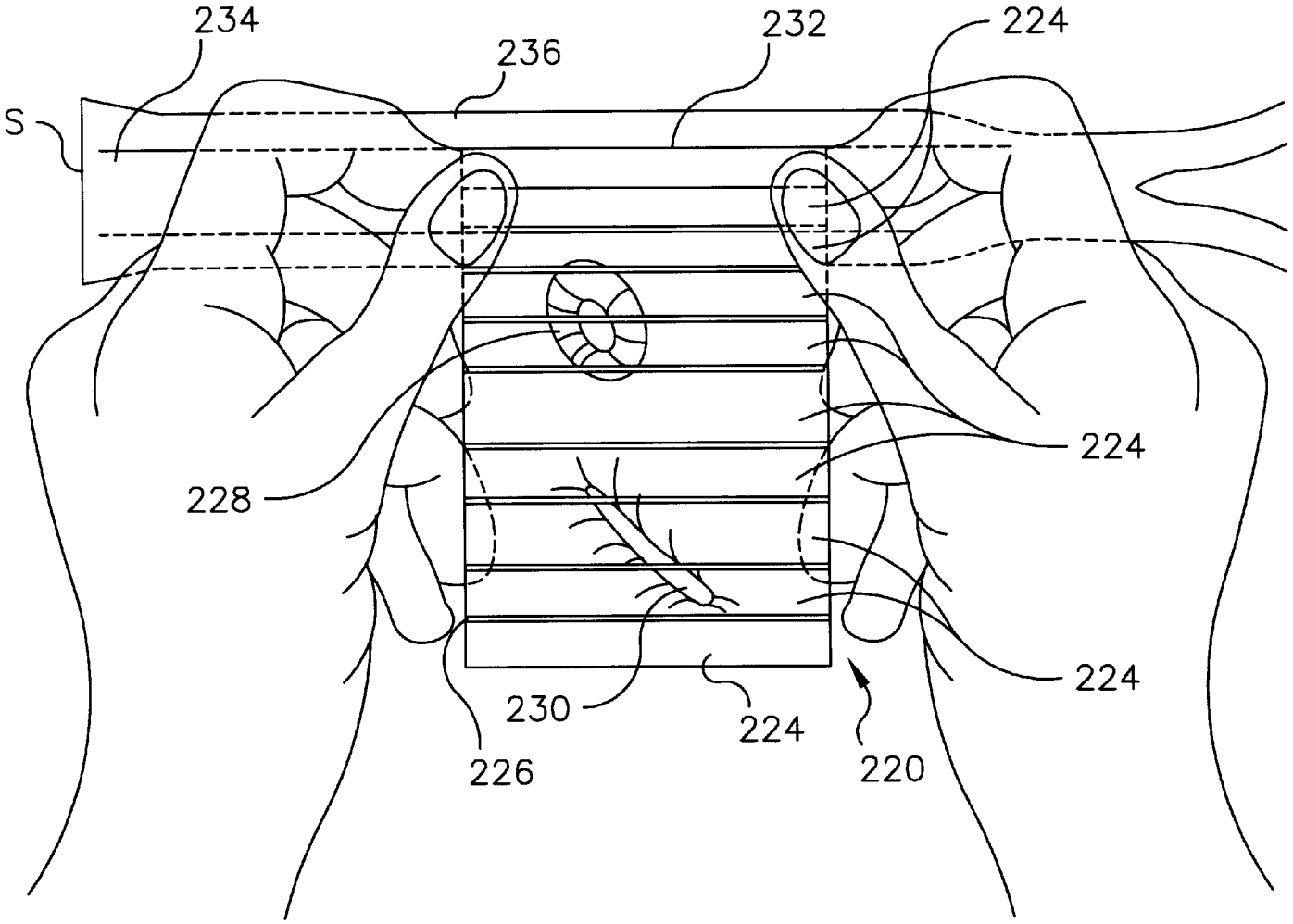
FIG. 39 is a side view of a racquet handle showing a contour assembly being applied to the handle as a wrap in accordance with another method of implementing the invention.

Referring now to FIG. 39, a contour assembly 220 is shown for use in accordance with another useful handle construction method. The contour assembly 220 is adapted for wrapping around and engaging the octagonal periphery 222 of a handle shaft S, one side of which is shown in FIG. 39. The contour assembly 220 may be formed as a continuous flexible sheet of material having one or more plies. Alternatively, as shown in FIG. 39, at least the outer portion thereof may be segmented into a series of parallel adjacent plates 224 that are separated by intermediate gaps 226. If a segmented construction is used, the plates 224 will preferably be generally rectangular when viewed in plan. Most of the contour assembly 220 is generally flat when viewed from the side. Selected portions thereof have surface relief contours that are shaped to provide a trigger 228 and a protuberance 230, respectively.

Figure 40:
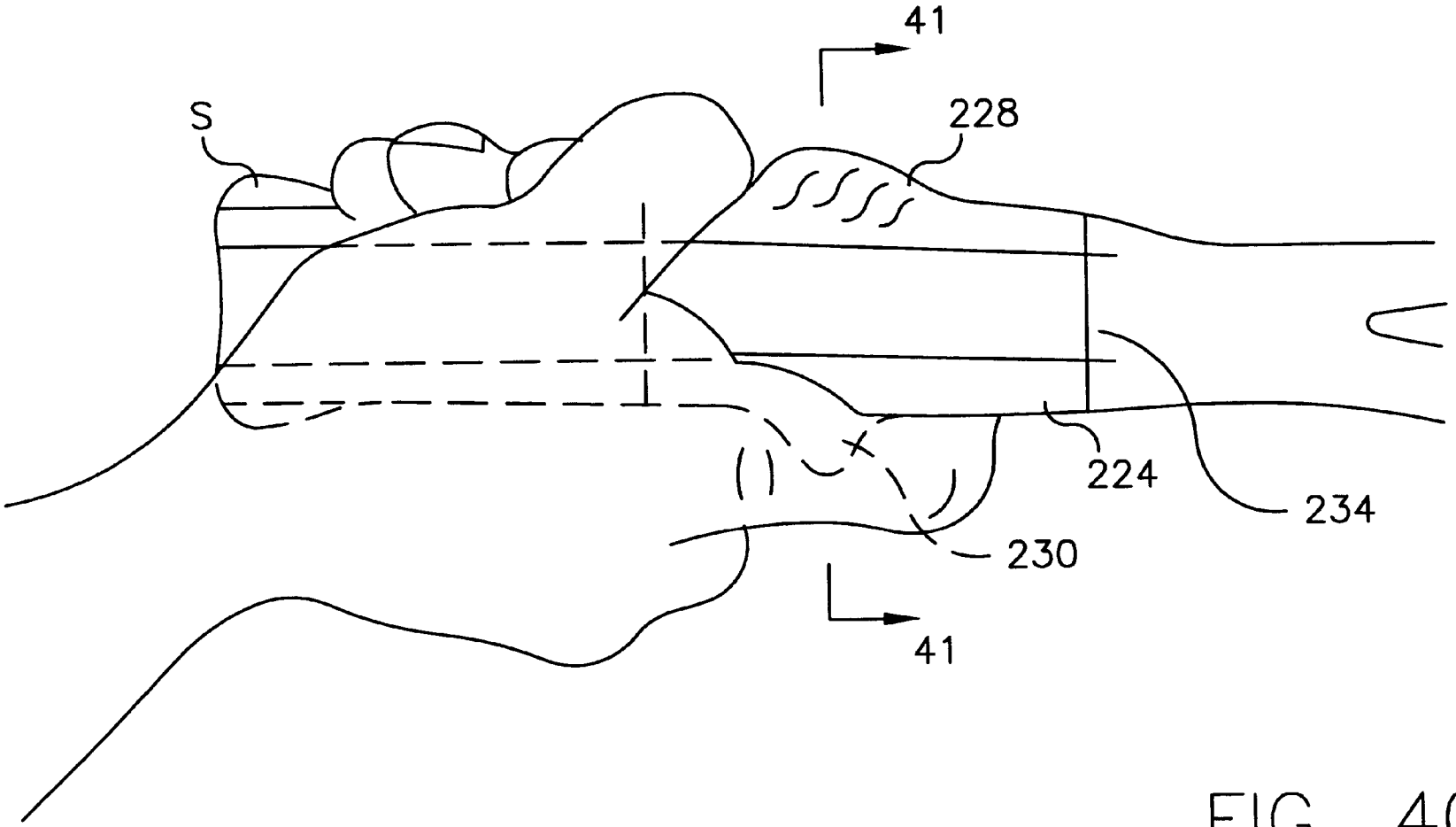
FIG. 40 is side view of a hand gripping the racquet of FIG. 39.

The contour assembly 220 is wrapped around the handle S in a clockwise direction starting at a location 232 on the right side 234 of the handle when viewing the handle from its base end. Preferably, the location 232 is at the ridge line representing the intersection between the right side wall and upper right-hand diagonal wall 236 of the handle S. The contour assembly 220 may be located at any desired distance from the base of the handle S. FIG. 40 shows the contour assembly 220 after it has been wrapped around the handle S and secured for use.

If a segmented construction is used as in FIG. 39, each of the plates 224 should be sized such that an integer number of plates, e.g., 1, 2, 3, etc., taking into account any intervening gaps 226 in the case of multiple plates, will span the entirety of each octagonal side of the handle S. This ensures that no plate extends over the intersection of any two handle sides. Only the gaps 226, if present, span such intersections.

Figure 41:
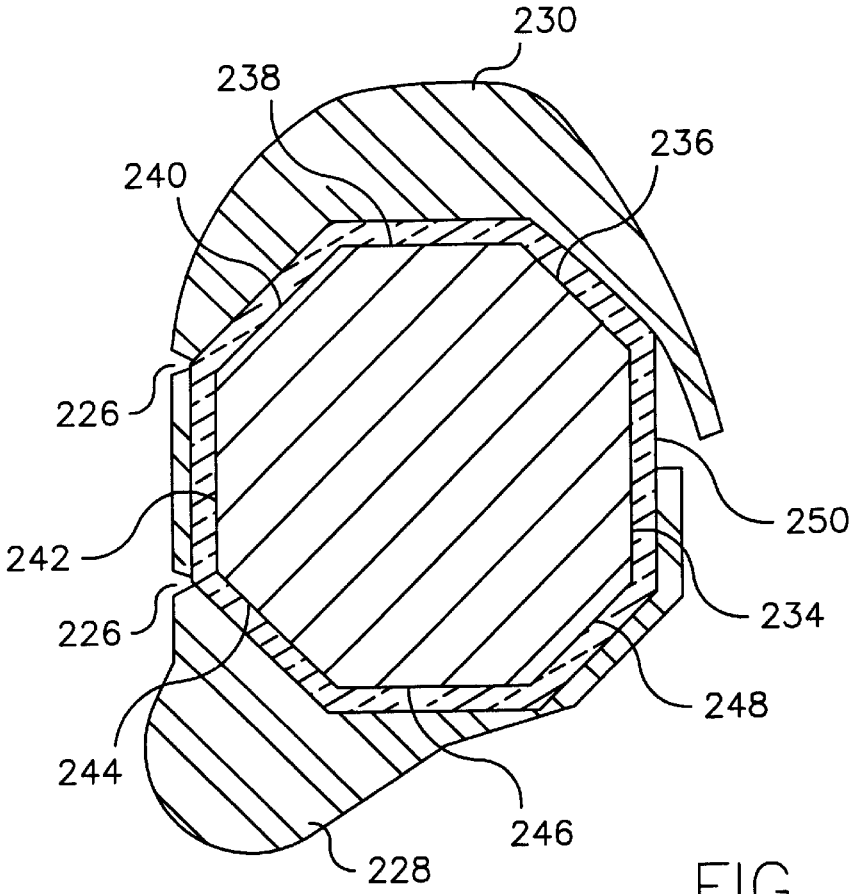
FIG. 41 is cross-sectional view taken along line 41—41 in FIG. 40.

Turning now to FIG. 41, the contour assembly 220 is shown after it has been wrapped around the octagonal sides 234, 236, 238, 240, 242, 244, 246 and 248 of the handle S. A layer of adhesive 250 that extends over all of the handle sides is used to secure the contour assembly 220 in place. The contour assembly 220 demonstrates the use of a partially segmented construction comprising two gaps 226. The remainder of the contour assembly 220 is continuous, at least in the area of the trigger 228 and the protuberance 230.

Figure 42:
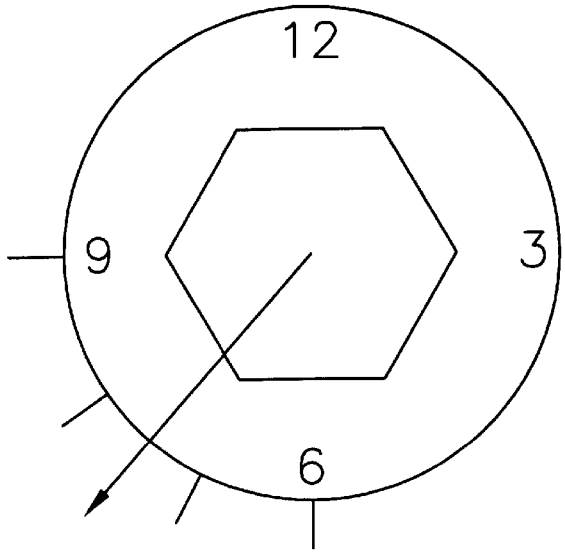
FIG. 42 is a diagrammatic illustration showing the orientation of components of the contour assembly of FIG. 39.

FIG. 42 illustrates the positioning of the trigger 244 at an approximate "7:30" position on the handle S, if the base of the handle is viewed as a clock face. As shown in previous FIG. 41, this positioning facilitates a Western grip. Other trigger positions between the "6:00" and "8:00" could also be used.

Figure 43A:
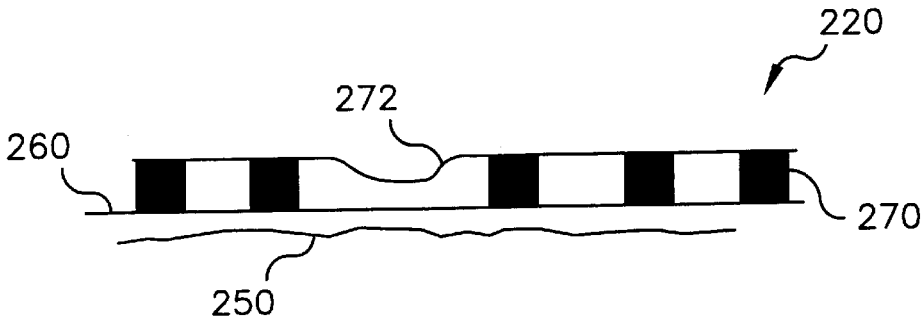
FIG. 43*a* is an enlargement of a portion of FIG. 41 showing a first alternative configuration for assisting the contour assembly of FIG. 39 to bend around a racquet handle.
Figure 43B:
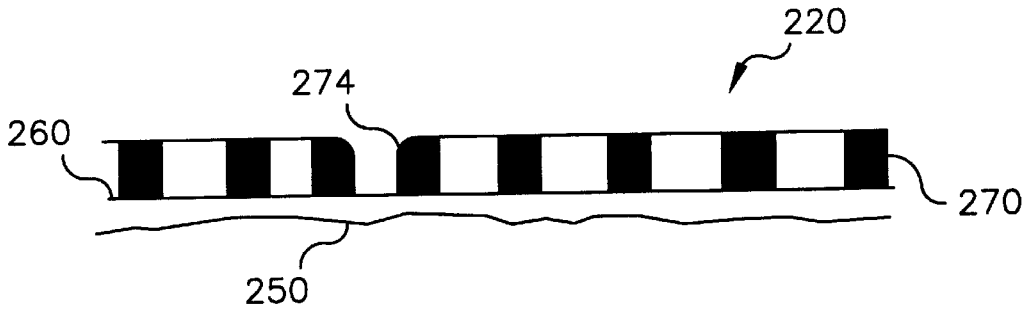
FIG. 43*b* is an enlargement of a portion of FIG. 41 showing a second alternative configuration for assisting the contour assembly of FIG. 39 to bend around a racquet handle.
Figure 43C:
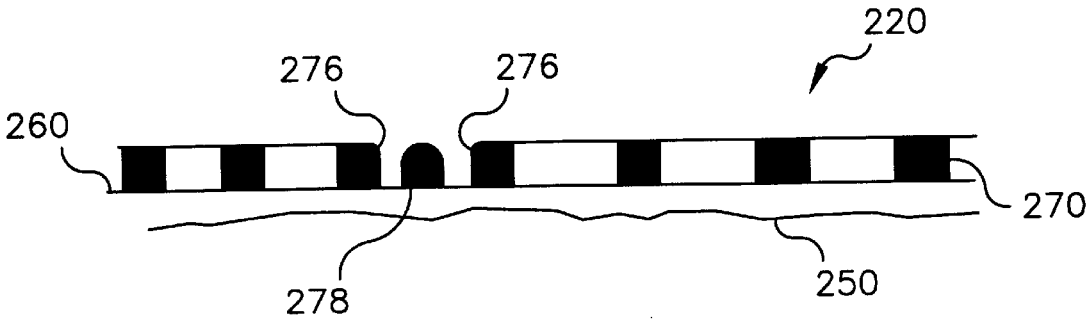
FIG. 43*c* is an enlargement of a portion of FIG. 41 showing a third alternative configuration for assisting the contour assembly of FIG. 39 to bend around a racquet handle.

FIGS. 43*a*, 43*b* and 43*c* illustrate construction details of the contour assembly 220. The inner side of the contour assembly is formed by a continuous layer of stiff but flexible sheet material 260, which could be either woven or non-woven. The adhesive layer 250 is placed on the bottom of the inner sheet layer 260. Preferably, an integrated material is used that provides both the inner sheet layer 260 and the adhesive layer 250. A backing sheet would typically be provided to cover the adhesive layer 250 until the contour assembly 220 is ready to be mounted on the handle S.

A outer layer 270 is mounted by any suitable means to the inner layer 260. The outer layer 270 can be made from any suitable semi-soft cushioning material, such as neoprene rubber, polyuerethane, etc., which can be molded to form the shapes required for the trigger 228 and the protuberance 230. It is the outer layer 270 which can be segmented to form the segmented construction of FIG. 39, or the partially segmented construction of FIG. 41, as desired.

FIG. 43*a* illustrates a segmented construction wherein the outer layer 270 is segmented by forming depressions 272 therein, such that the gaps 226 represent areas of reduced thickness of the outer layer 270. FIG. 43*b* illustrates a segmented construction wherein the outer layer 270 is segmented by forming interruptions 274 therein, such that the gaps 226 represent areas of complete elimination of the outer layer 270. FIG. 43*c* illustrates a segmented construction wherein the outer layer 270 is segmented by forming dual interruptions 276 therein, such that the gaps it 226 represent two areas of complete elimination of the outer layer 270, separated by a thin line 278 of the outer layer 270.

Figure 44:
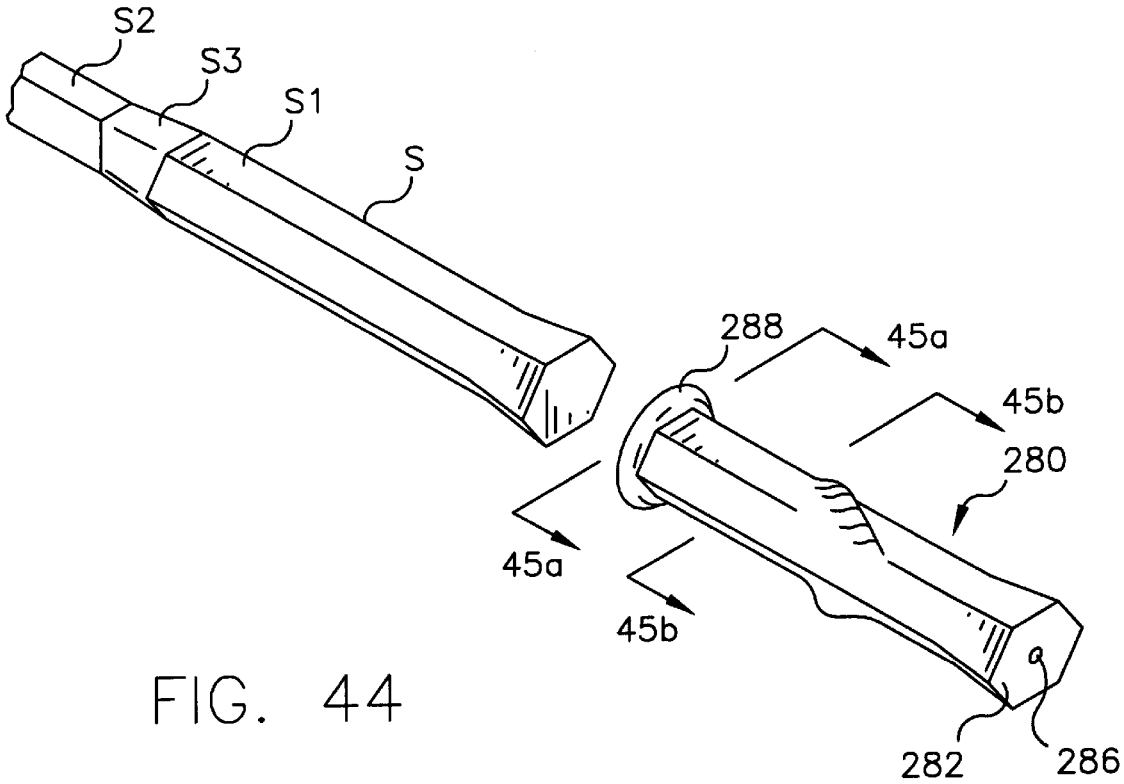
FIG. 44 is a perspective view of a racquet handle showing a contour assembly being applied to the handle as a boot in accordance with another method of implementing the invention.
Figure 45A:
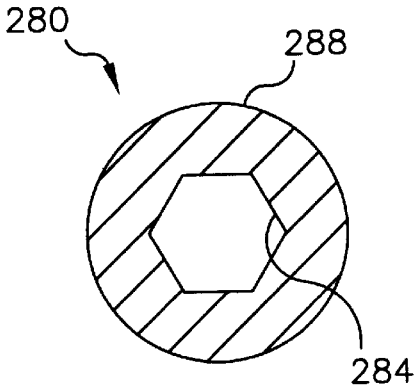
FIGS. 45*a* and 45*b* are cross-sectional views of the contour assembly of FIG. 44 taken substantially along lines 45*a*—45*a* and 45*b*—45*b*, respectively.
Figure 45B:
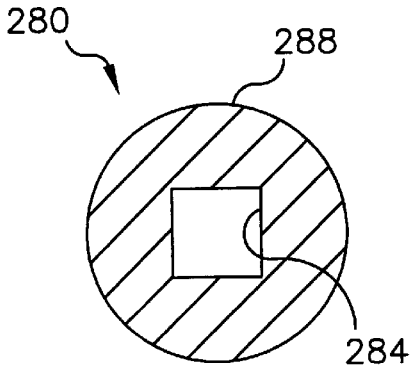

Referring now to FIG. 44, a contour assembly in the form of a unitary molded handle boot element 280 is shown. The boot 280 is adapted for mounting on a handle shaft S by pulling the boot over the base end of the handle until it bottoms out on the base end 282 of the boot. The handle shaft S has an octagonal portion S1, a rectangular portion S2, and a transitional portion S3. The boot has an elongated well 284 therein for receiving the handle S. As shown in FIGS. 45*a* and 45*b*, the well 284 has a rectangular portion sized to accommodate the handle portion S2, and an octagonal portion sized to accommodate the handle portions S1 and S3. A vent hole 286 is formed at the bottom of the well 284 to release trapped air as the boot is placed on the handle S. To assist in mounting the boot 280 over the handle S, a collar 288 is provided at the forward end thereof. This collar can be cut away from the boot 280 after mounting is completed.

The boot 280 can be made from any semi-soft cushioning material that is also resilient so that the boot can stretch when it is placed over the handle S. It can be molded using conventional injection molding techniques, with an insert being used to define the well 284. The well 284 is preferably made smaller than the cross-sectional size of the handle S so that the boot fits snugly thereon. To permanently secure the boot 280 to the handle S, the handle is coated with an adhesive such as contact cement, or a two-sided adhesive tape, prior to mounting. In either case, it may be desirable to apply a suitable softening agent, such as alcohol, immediately prior to mounting the boot 280 to facilitate its placement on the handle S. After mounting, the boot should be left undisturbed for a period of time that allows the adhesive to cure.

Figure 46:
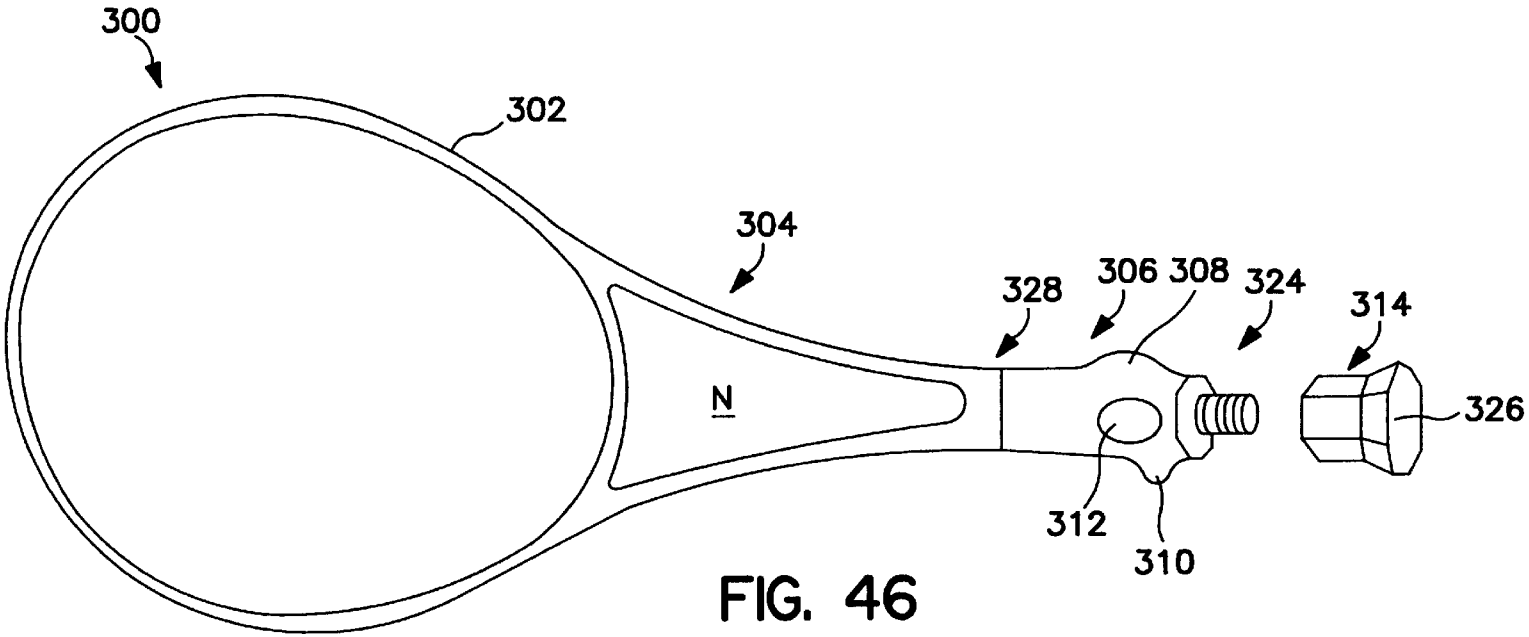
FIG. 46 is a perspective view of a racquet having a racquet handle that includes a permanently mounted contour assembly and a removable base member threadably engaging the end of the contour assembly in accordance with another method of implementing the invention.
Figure 47:
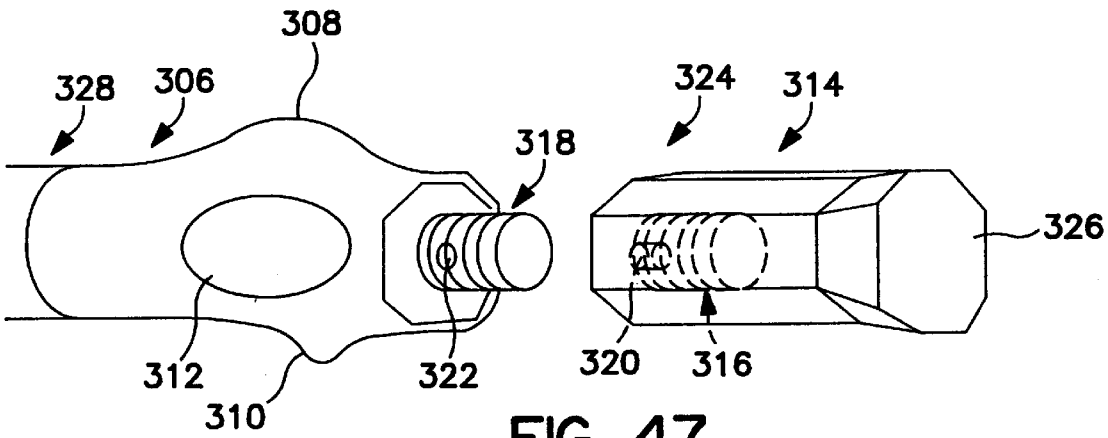
FIG. 47 is a detailed perspective view showing the racquet handle of FIG. 46.

Referring now to FIG. 46, a racquet 300, which by way of example could be a tennis racquet, includes a racquet head 302, a racquet neck N formed by dual neck members 304 mounted to the head 302, and a contour assembly 306 mounted to the neck N. As used herein, the term "mount" in reference to the connection between the neck N and the contour assembly 306 includes separate components attached together (either fixedly or adjustably), as well as integrally formed components. In the embodiment of FIG. 46, the contour assembly 306 is preferably permanently mounted to the racquet neck N. The contour assembly 306 has a surface configuration in accordance with a designed contour that preferably includes an upper protrusion 308 and a lower trigger 310. A thumb depression 312 could be further provided.

To provide adjustability of the position of the contour assembly 306 relative to the base end of the racquet 300, a removable handle base member 314 is securable to the contour assembly 306. The base member 314 has a longitudinally-extending threaded bore 316 therein that receives a threaded stub 318 extending longitudinally from, and which is fixedly mounted to, the base end of the contour assembly 306. To secure the base member 314 against loosening after it is fully threadably mounted on the stub 318, a set screw (not shown) is inserted into threaded holes 320 and 322 formed in the base member 314 and the stub 318, respectively. Together, the contour assembly 306 and the base member 314 provide a handle 324 having a handle base end 326 and a handle head end 328. The length of the handle 324 can be adjusted by utilizing base members 314 of different length. This effectively changes the longitudinal position of the contour assembly 306 relative to the base end 326 of the handle 324 without having to move the contour assembly 306 on a handle shaft.

Figure 48:
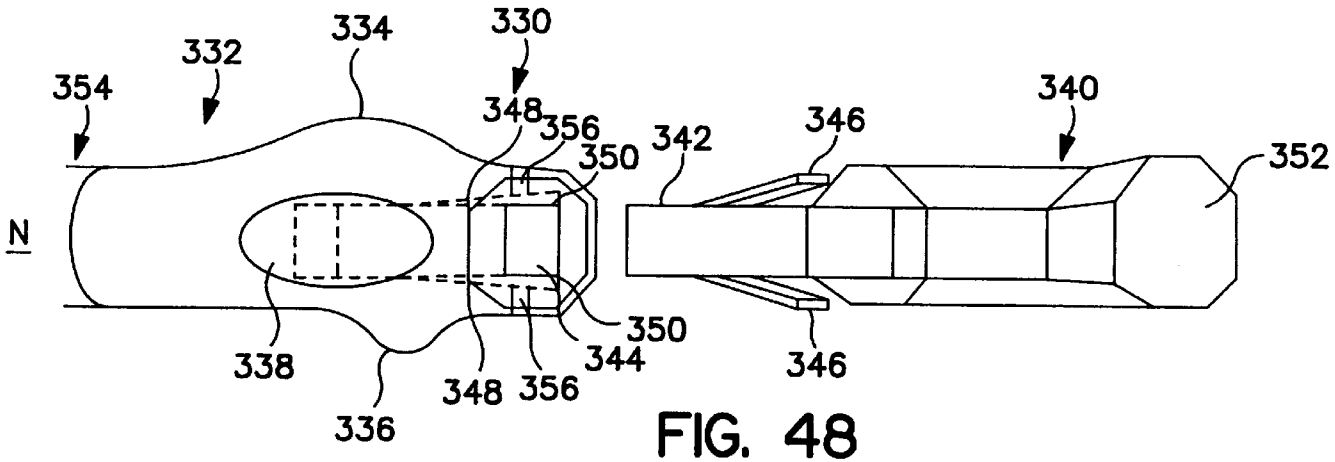
FIG. 48 is a perspective view of a racquet handle that includes a permanently mounted contour assembly and a removable base member having a shaft received in a corresponding bore in the contour assembly and retained therein using flexible locking tabs in accordance with another method of implementing the invention.

Referring now to FIG. 48, a racquet handle 330 includes a contour assembly 332 permanently mounted to a racquet neck N. The contour assembly 332 has a surface configuration in accordance with a designed contour that preferably includes an upper protrusion 334 and a lower trigger 336. A thumb depression 338 could be further provided.

A removable handle base member 340 is securable to the contour assembly 332. The base member 340 has an axially-extending rectangular stub 342 that is received in a corresponding rectangular channel 344 formed in the contour assembly 332. The stub 342 has a pair of flexible locking tabs 346 extending from opposing sides thereof. The tabs 346 are accommodated in wedge shaped recesses 348. When the stub 342 is fully received in the channel 344, the free ends of the tabs 346 engage shoulders 350 formed at the ends of the recesses 348. This engagement fully secures the base member 340 against the contour assembly 332.

Together, the contour assembly 332 and the base member 340 provide a handle 330 having a base end 352 and a head end 354. To release the base member 340 from the contour assembly 332, a pair of holes 356 are formed in the contour assembly 332 for accessing the tabs 346 with an elongated implement, such as a screw driver, that can be used to deflect the tabs 346 out of engagement with the shoulders 350. The length of the handle 330 can be adjusted by attaching base members 340 of different length. This effectively changes the longitudinal position of the contour assembly 332 relative to the base end 352 of the handle 330 without having to move the contour assembly 332 on a handle shaft.

Figure 49:
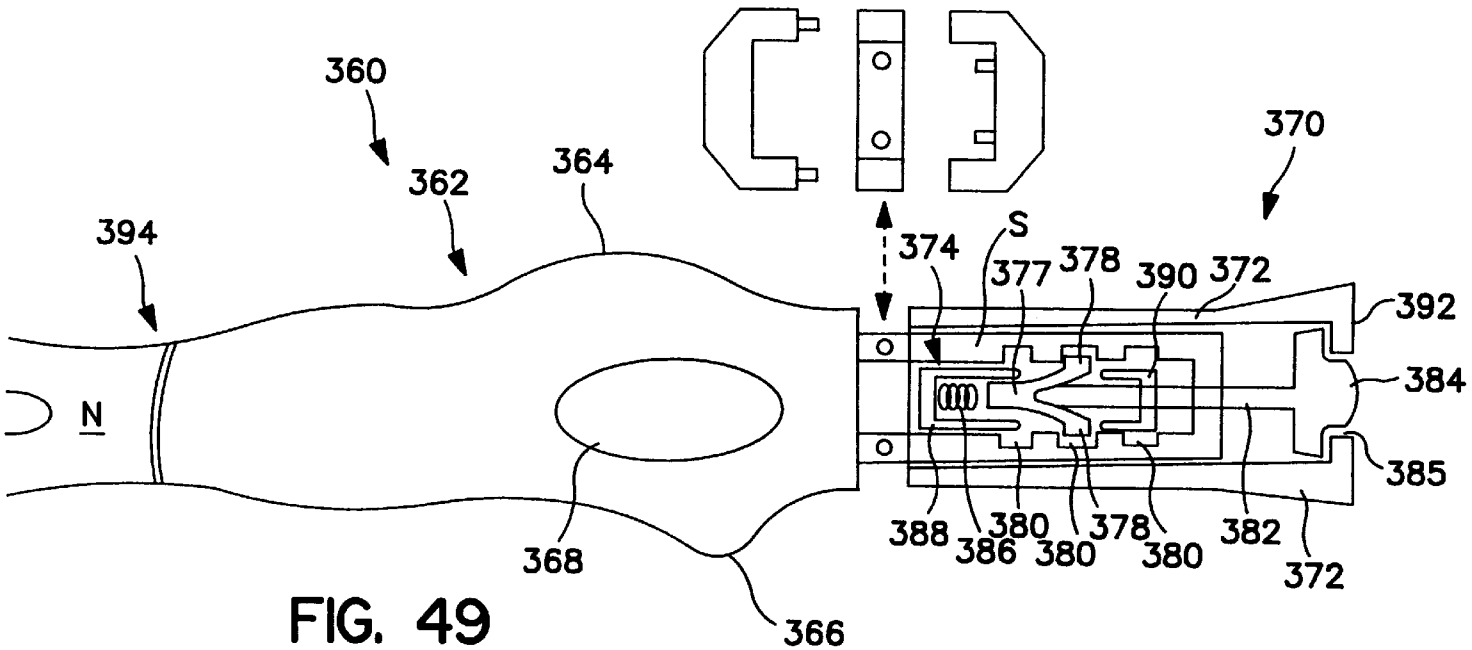
FIG. 49 is a partial side, partial cross-sectional view of a racquet handle that includes a permanently mounted contour assembly, a handle shaft stub extending from the contour assembly, and a removable base member received on the handle shaft stub and retained thereon using button-actuated releasable detents in accordance with another method of implementing the invention.
Figure 50:
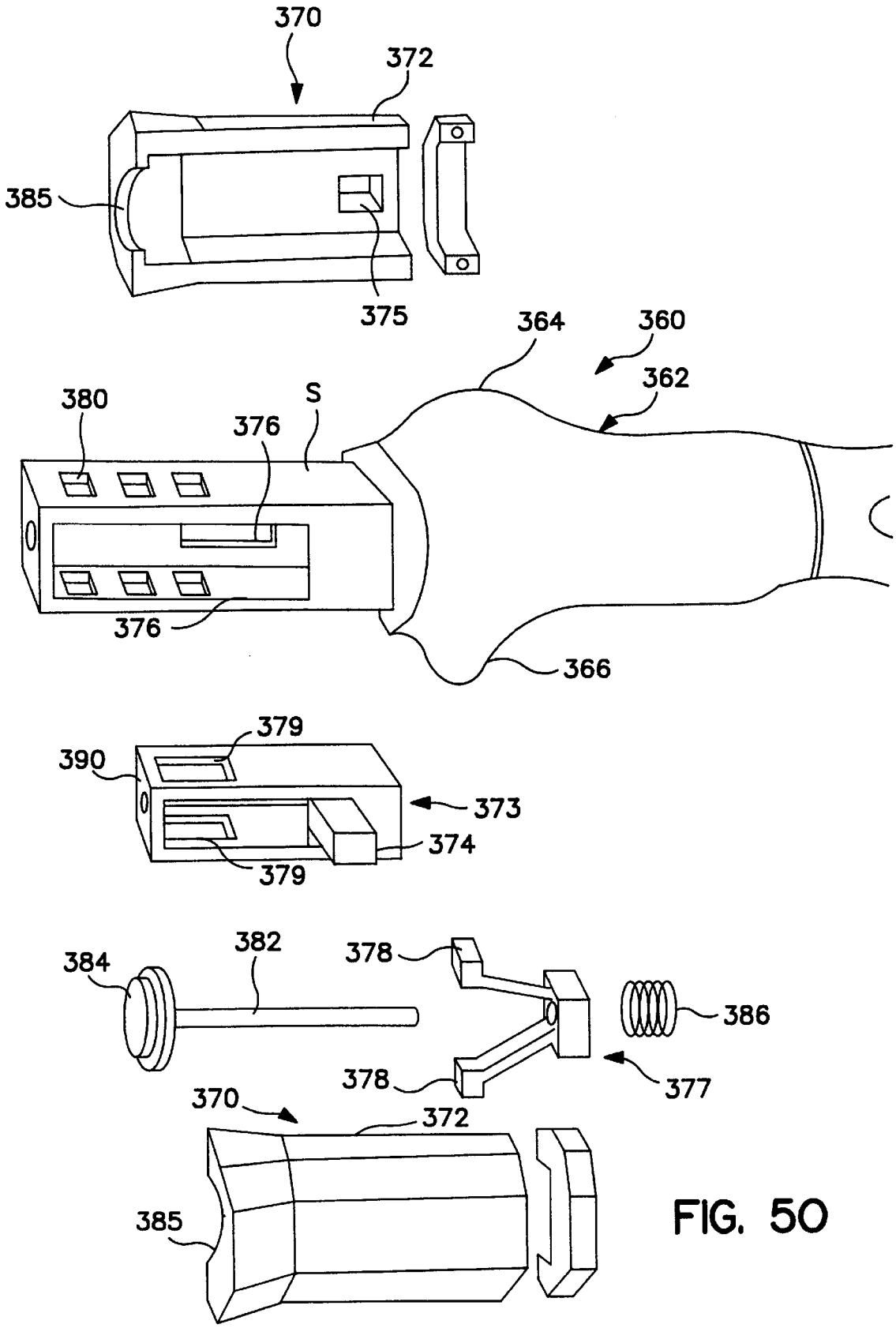
FIG. 50 is an exploded perspective view showing the components of the racquet handle of FIG. 49.
Figure 51:
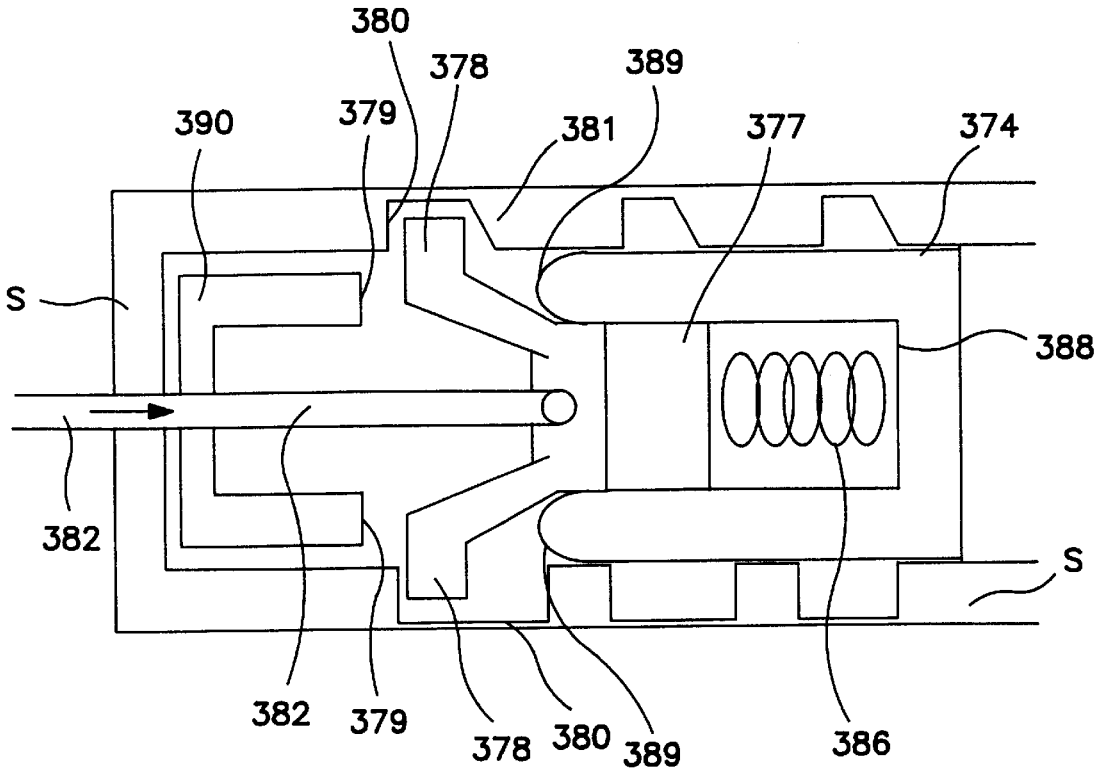
FIG. 51 is a detailed cross-sectional view of the racquet handle of FIG. 49.

Referring now to FIGS. 49–51, a racquet handle 360 includes a contour assembly 362 permanently mounted to a racquet neck N. The contour assembly 362 has a surface configuration in accordance with a designed contour that preferably includes an upper protrusion 364 and a lower trigger 366. A thumb depression 368 could be further provided.

A handle base member 370 is secured to a handle shaft stub S extending longitudinally from, and which is fixedly mounted to, the contour assembly 362. The base member 370 has two outer sleeve halves 372 and an inner lock mechanism 373. The lock mechanism 373 attaches to the outer sleeve halves 372 via interconnecting longitudinal pegs 374 (one is shown in FIG. 50) that are received in corresponding recesses 375 formed in the outer sleeve halves 372 (one is shown in FIG. 50). The handle shaft stub S has a hollow interior that receives the lock mechanism 373. The pegs 373 are accommodated by longitudinal slots 376 formed in the handle shaft stub S. One of the slots 376 is larger than the other to allow the lock mechanism 373 to be inserted into the hollow interior of the handle shaft S.

The lock mechanism 373 itself has a hollow interior that receives a detent member 377 having a pair of detent tabs 378. The detent tabs 378 extend through slots 379 formed in the lock mechanism 373, and are configured to engage one of several pairs of longitudinally spaced slots 380 formed on opposing inner sides of the handle shaft stub S. FIG. 51 shows two alternative constructions in which the end of each slot 380 that is closest to the contour assembly 362 can either be angled, as shown at 381, or non-angled. A first end of the detent member 377 is mounted to a plunger 382 that extends longitudinally from the detent member 377 to a button 384. A second end of the detent member 377 engages a spring 386 that is retained within a spring receptacle 388 portion of the lock mechanism 373, which extends forwardly from the slots 379 toward the contour assembly 362. The spring 386 biases the detent member 377 such that the detent tabs 378 are urged into engagement with the slots 380. This holds the base member 370 securely in position against the contour assembly 362.

The base member 370 is released from the handle shaft stub S by depressing the button 384, which is accessible through a hole 385 formed in one end of the base member 370. This pushes the detent member 377 into the spring receptacle 388. The detent tabs 378 engage rounded shoulders 389 formed on the side of the slots 379 that is closest to the contour assembly 362, and the detent tabs are deflected out of engagement with the slots 380. A plunger support portion 390 of the lock mechanism 373 guides the plunger 382 during this longitudinal motion.

Together, the contour assembly 362 and the base member 370 provide a handle 360 having a base end 392 and a head end 394. The length of the handle 330 can be adjusted by attaching base members 370 of different length. This effectively changes the longitudinal position of the contour assembly 362 relative to the base end 392 of the handle 360 without having to move the contour assembly 362 on a handle shaft.

Figure 52:
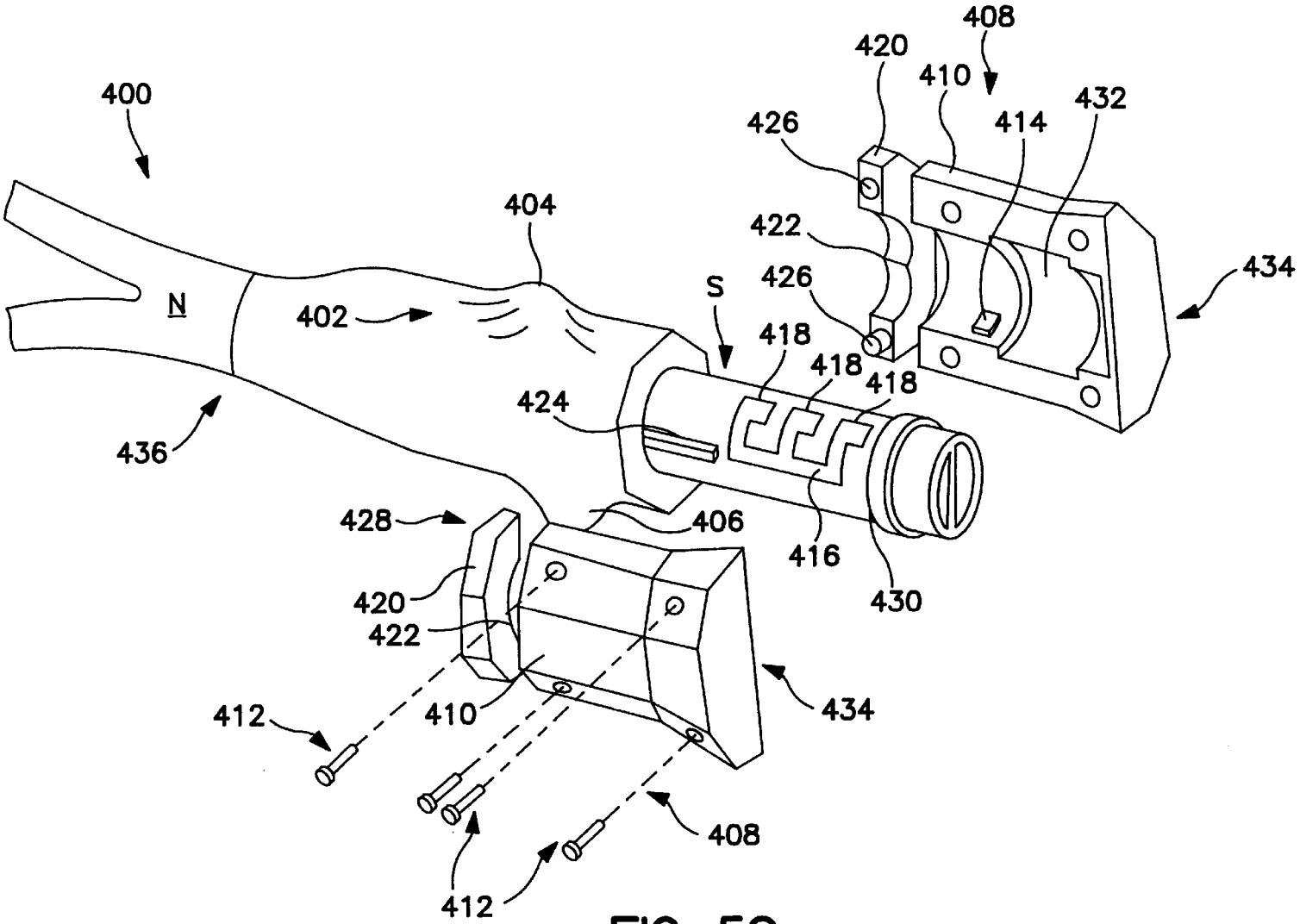
FIG. 52 is a perspective view of a racquet handle that includes a permanently mounted contour assembly, a handle shaft stub extending from the contour assembly, and a removable base member received on the handle shaft stub and retained thereon using a peg and locking slot arrangement in accordance with another method of implementing the invention.

Referring now to FIG. 52, a racquet handle 400 includes a contour assembly 402 permanently mounted to a racquet neck N. The contour assembly 402 has a surface configuration in accordance with a designed contour that preferably includes an upper protrusion 404 and a lower trigger 406.

A removable handle base member 408 is securable to a handle shaft stub S extending longitudinally from, and which is fixedly mounted to, the contour assembly 402. The base member 408 is formed with two sleeve halves 410 that can be mounted together using fasteners, such as screws 412, or other appropriate mounting methods such as adhesive bonding or sonic welding (if the sleeve halves are plastic). The inner surface of each sleeve half 410 is formed with a peg 414 (only one is shown) that is received in a main slot 416 (only one is shown) formed in the handle shaft stub S. When the pegs 414 are located in the main slot 416, the base member 408 can be moved axially along the handle shaft stub S to adjust the length of the handle 400. When the desired length has been achieved, the base member 408 is rotated clockwise to slide the pegs 414 into one of several L-shaped slot extensions 418 oriented transversely to the main slot 416.

One or more gap filler members 420 can be used to fill the gap, if any, between the contour assembly 402 and the base member 408. For stability, each gap filler member 420 preferably includes a peg 422 that engages a groove 424 (only one is shown) formed in the handle shaft stub S. Snaps 426, or any other removable connection, can be used to removably mount the gap filler members on the handle shaft stub S. The mating ends of the gap filler members 420 can be tapered at 428 to allow them to be wedged into place, if necessary. As a precaution against inadvertent separation of the base member 408 from the handle shaft stub S during racquet use, a safety collar 430 is formed on the handle shaft stub S to engage a groove 432 formed in the base member 408.

Together, the contour assembly 402 and the base member 408 provide a handle 400 having a base end 434 and a head end 436. The length of the handle 400 can be adjusted by locking the base member 408 in different ones of the slot extensions 418. This effectively changes the longitudinal position of the contour assembly 402 relative to the base end 434 of the handle 400 without having to move the contour assembly 402 on a handle shaft.

Figure 53:
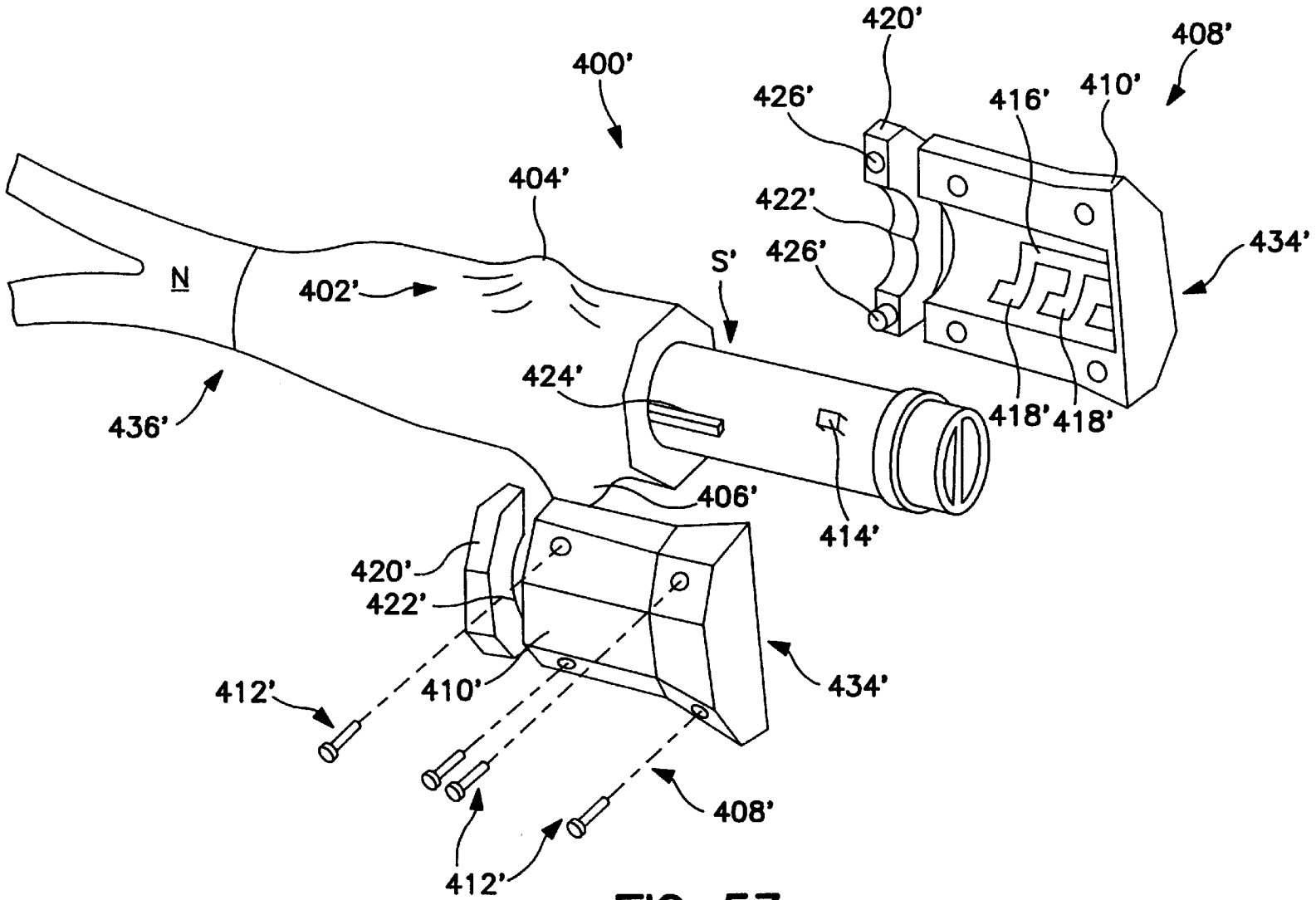
FIG. 53 is a perspective view of a racquet handle that includes a permanently mounted contour assembly, a handle shaft stub extending from the contour assembly, and a removable base member received on the handle shaft stub and retained thereon using another peg and locking slot arrangement in accordance with another method of implementing the invention.
Figure 54D:
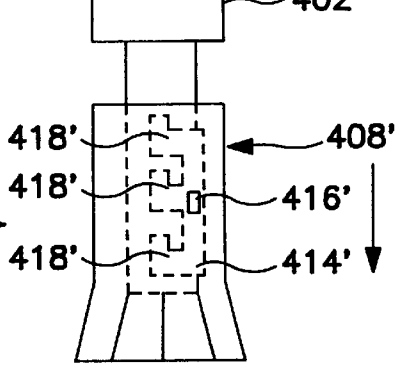
-FIGS. 54*a*, 54*b*, 54*c*, and 54*d*, is a detailed plan view of the racquet handle of FIG. 53 showing the inter-engagement between the pegs and locking slots thereof during various phases of unlocking.
Figure 54C:
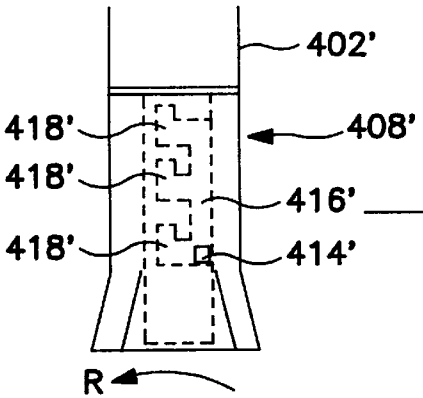
Figure 54B:
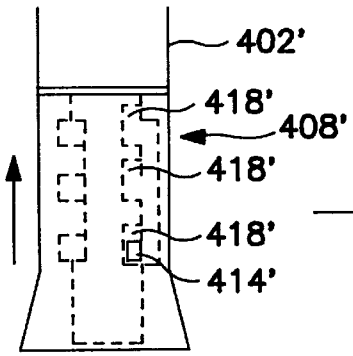
Figure 54A:
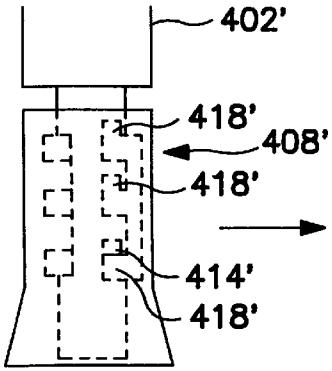
Figure 55:
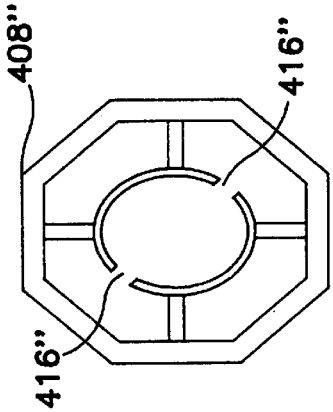
FIG. 55 is a cross-sectional view showing an alternative single-piece construction for the base portion of the racquet handle of FIG. 53.

Referring now to FIGS. 53–55, a racquet handle 400' is shown which is identical in most respects to the racquet handle 400 of FIG. 52 except that the pegs 414' are located on the handle shaft stub S' and the main slots 416' and slot extensions 418' are located on the base member 408'. FIGS. 54*a*, 54*b*, 54*c* and 54*d* further illustrate how the pegs 414' lock into the slot extensions 418'. FIG. 54*a* shows the base member 408' in its fully locked position. FIG. 54*b* shows the base member 408' after it has been pushed toward the contour assembly 402'. One of the pegs 414' is shown as being ready for disengagement from a slot extension 418' in which it was mounted. FIG. 54*c* shows the peg 414' after it has been rotated out of the slot extension 418' and into the main slot 416'. FIG. 54*d* shows the peg 414' after is has been moved along the main slot 416' to a new slot extension 418'. This is achieved by pulling the base member 408' away from the contour assembly 402'.

FIG. 55 illustrates an alternative one-piece base member 408" with main slots 416" (the slot extensions are not shown). The base member 408" could be made of molded plastic or any other suitable material. For weight reduction, the base member 408" preferably has a substantially hollow interior.

Figures 56, 57:
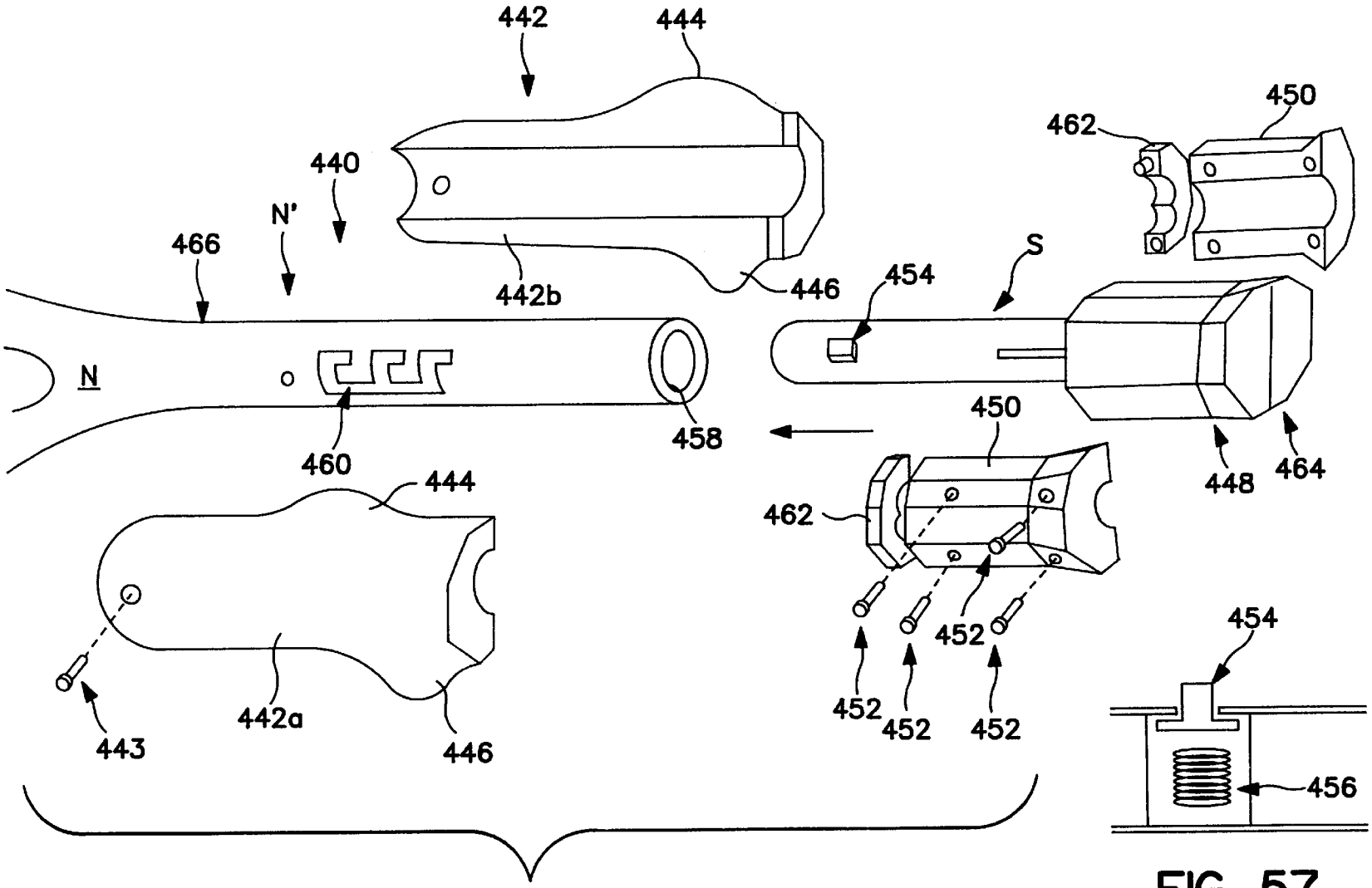
FIG. 56 is a perspective view of a racquet handle that includes a contour assembly, a removable base member and a handle shaft stub extending from the base member, the handle shaft stub being received in a cavity formed in the contour assembly and being retained therein using a spring-biased pin and slot arrangement in accordance with another method of implementing the invention.
FIG. 57 is a detailed cross-sectional view showing the spring-biased pin of the racquet handle of FIG. 56.
Figures 58, 59:
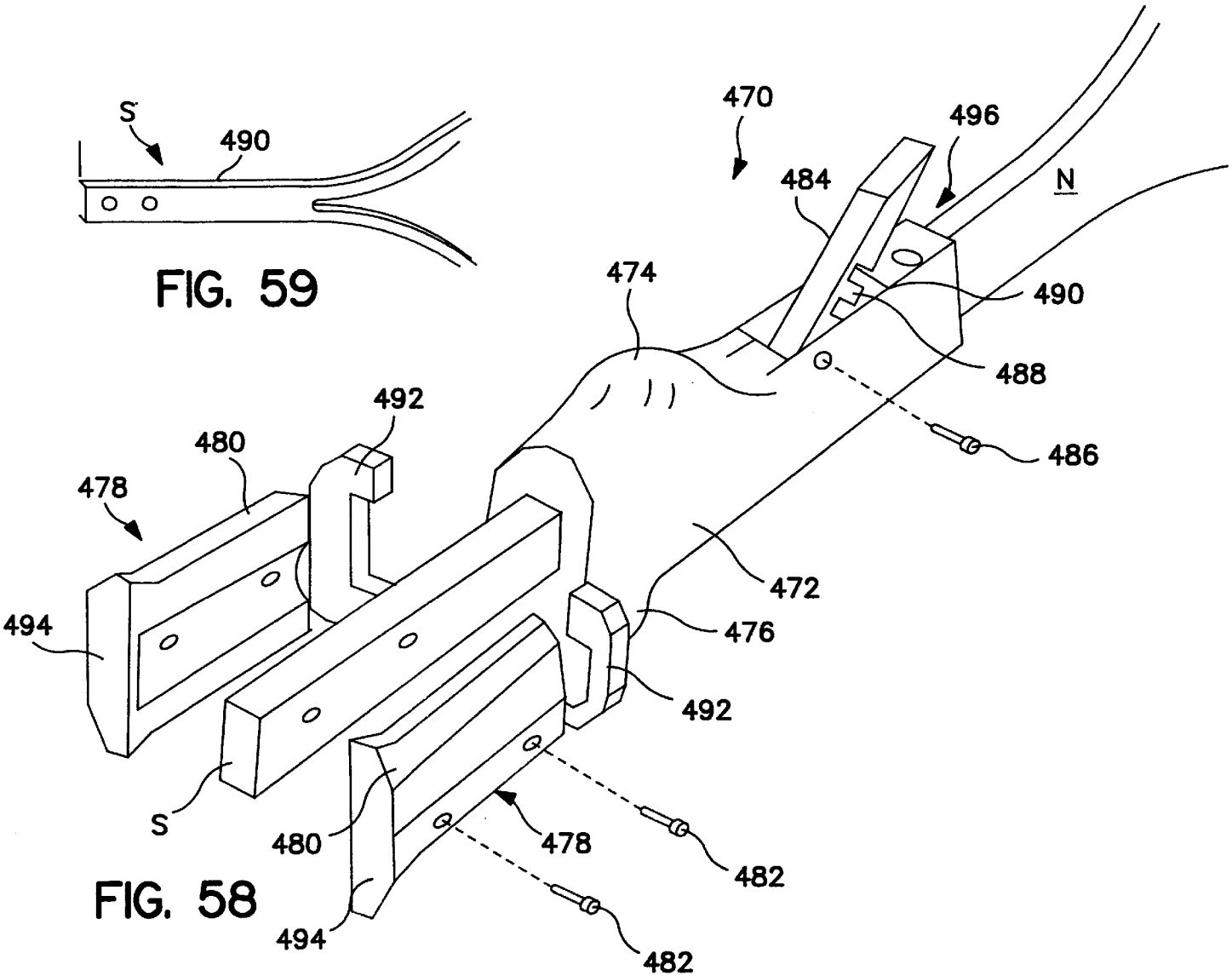
FIG. 58 is a perspective view of a racquet handle that includes an adjustably mounted contour assembly, a handle shaft stub extending from the contour assembly, a removable base member received on the handle shaft stub, the contour assembly being removably mounted to a racquet with a pivoting lock arm that engages teeth formed on the racquet in accordance with another method of implementing the invention.
FIG. 59 is a detailed perspective view showing a racquet with teeth formed thereon for mounting the contour assembly of FIG. 58.
Figures 60, 61:
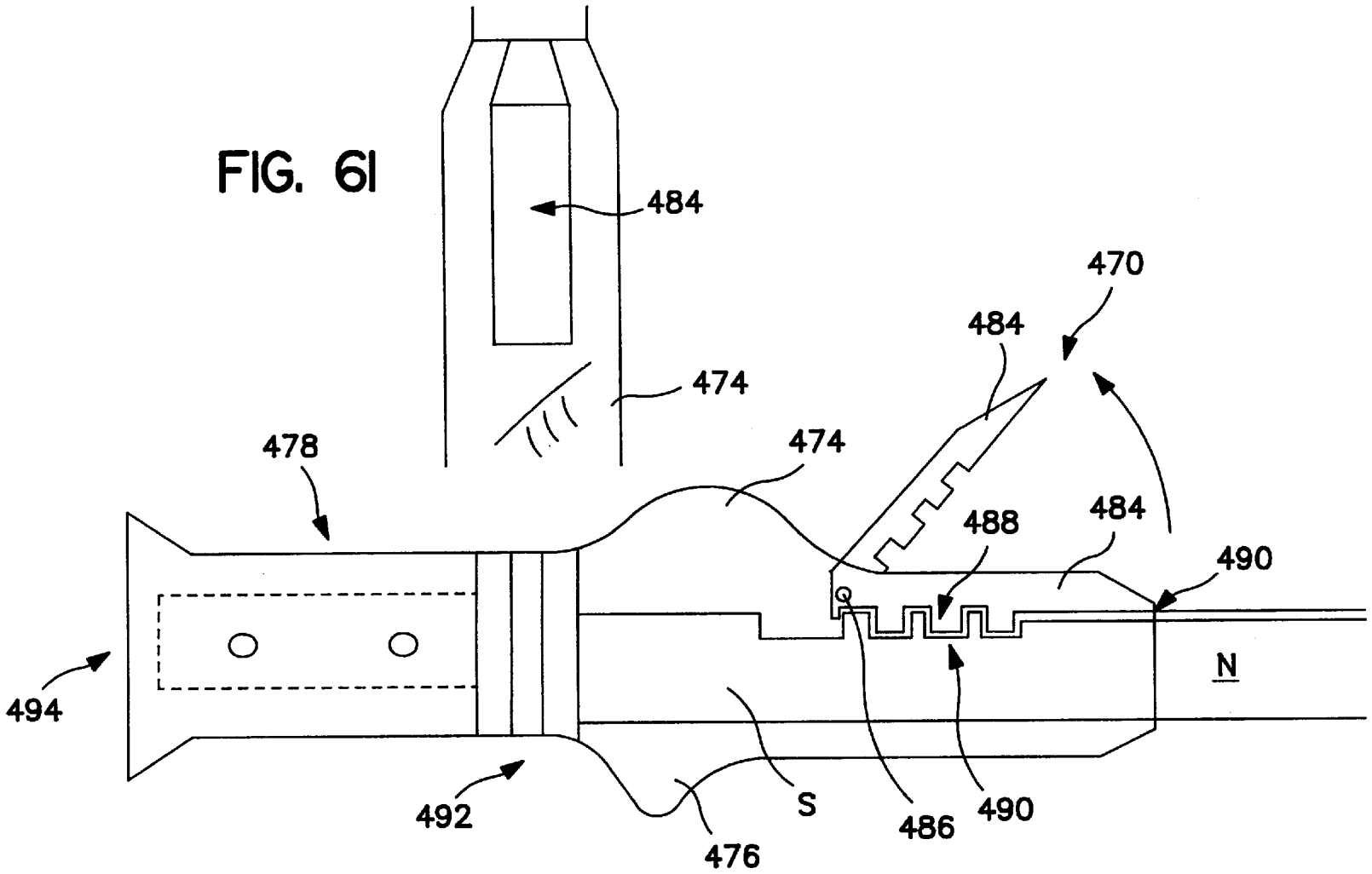
FIG. 60 is a side view of the racquet handle of FIG. 58.
FIG. 61 is a plan view of the racquet handle of FIG. 58.

Referring now to FIGS. 56 and 57, a racquet handle 440 includes a contour assembly 442 that is permanently or removably mounted to a racquet neck N. The contour assembly 442 mounts to an elongated portion of the racquet neck N which shall be referred to as stub N'. The contour assembly 442 has a surface configuration in accordance with a designed contour that preferably includes an upper protrusion 444 and a lower trigger 446. The surface configuration of the contour assembly 442 can be provided by two pieces 442*a* and 442*b* that are mounted on the stub N' using suitable fasteners, such as one or more screws 443.

A removable handle base member 448 is securable to a handle shaft stub S. The base member 448 is formed with two sleeve halves 450 that can be mounted together using fasteners, such as screws 452, or other appropriate mounting methods such as adhesive bonding or sonic welding (if the sleeve halves are plastic). The handle shaft stub S is provided with opposing pins 454 (only one is shown) that are biased by springs 456, as shown in FIG. 57.

The contour assembly 442, and specifically the stub N', is formed with an interior, axially-extending channel 458 that receives the handle shaft stub S. Opposing slot arrangements 460 (only one is shown) receive the pins 454 and allow the base member 448 to adjustably mount to the contour assembly 442 using the rotate/lock-rotate/unlock procedure described in connection with the handles 400 and 400' of FIGS. 52–55. One or more gap filler members 462 can be used to fill the gap, if any, between the contour assembly 442 and the base member 448.

Together, the contour assembly 442 and the base member 448 provide a handle 440 having a base end 464 and a head end 466. The length of the handle 440 can be adjusted by locking the pins 454 of the base member 448 in different ones of the slot extensions within the slot arrangements 460. This effectively changes the longitudinal position of the contour assembly 442 relative to the base end 464 of the handle 440 without having to move the contour assembly 442 on a handle shaft.

Referring now to FIGS. 58–61, a racquet handle 470 includes an adjustably mounted contour assembly 472 having a surface configuration in accordance with a designed contour that preferably includes an upper protrusion 474 and a lower trigger 476.

A removable handle base member 478 is securable to a handle shaft stub S that extends from a racquet neck N. The base member 478 is formed with two sleeve halves 480 that can be mounted together using fasteners, such as screws 482, or other appropriate mounting methods such as adhesive bonding or sonic welding (if the sleeve halves are plastic).

The contour assembly 472 is formed with a pivoting lock arm 484 that is mounted thereto using a pivot pin 486. The lock arm 484 has a tooth pattern 488 that engages a corresponding tooth pattern 490 formed on the racquet neck N. One or more gap filler members 492 can be used to fill the gap, if any, between the contour assembly 472 and the base member 478.

Together, the contour assembly 472 and the base member 478 provide a handle 470 having a base end 494 and a head end 496. The length of the handle 470 can be adjusted by disengaging the pivoting lock arm 484 from the neck N and sliding the contour assembly 472 to a desired position. Closing the pivotal lock arm 484 relocks the contour assembly 472 on the neck N.

Figure 62:
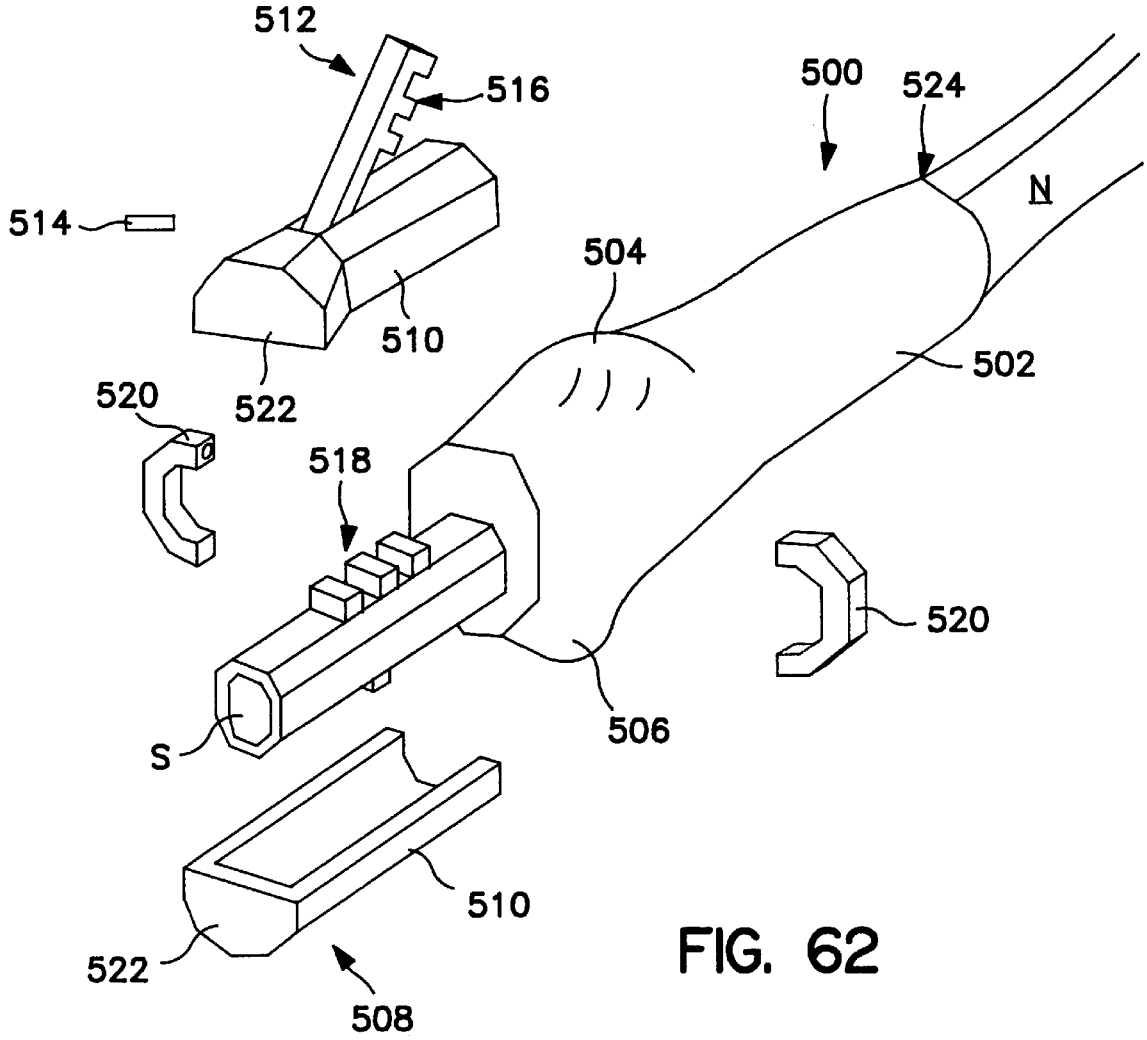
FIG. 62 is a perspective view of a racquet handle that includes a permanently mounted contour assembly, a handle shaft stub extending from the contour assembly, a removable base member received on the handle shaft stub, the base member being removably mounted to the handle shaft stub with a pivoting lock arm that engages teeth formed on the handle shaft stub in accordance with another method of implementing the invention.
Figure 63:
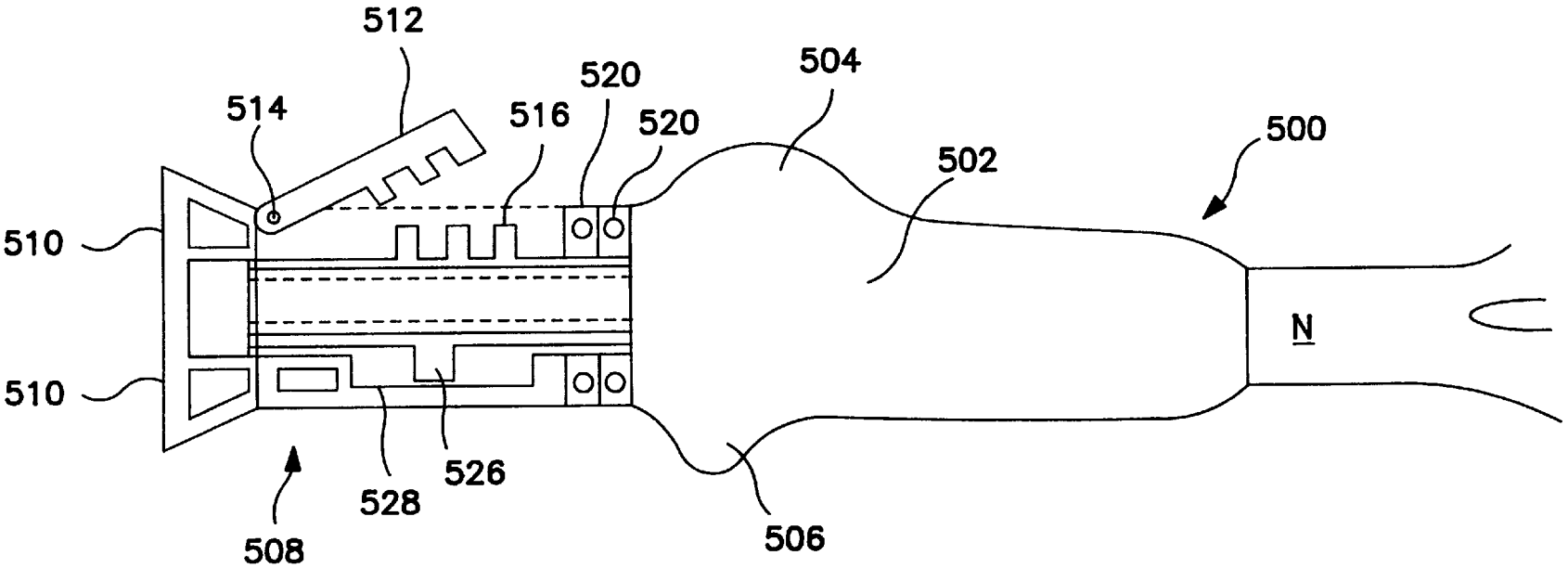
FIG. 63 is a side view of the racquet handle of FIG. 62.

Referring now to FIGS. 62 and 63, a racquet handle 500 includes a permanently mounted contour assembly 502 having a surface configuration in accordance with a designed contour that preferably includes an upper protrusion 504 and a lower trigger 506.

A removable handle base member 508 is securable to a handle shaft stub S that extends from the contour assembly 502. The base member 508 is formed with two sleeve halves 510 that can be mounted together using fasteners, such as screws (not shown), or other appropriate mounting methods such as adhesive bonding or sonic welding (if the sleeve halves are plastic).

The base member 508, and specifically, one of the sleeve halves 510, is formed with a pivoting lock arm 512 that is mounted thereto using a pivot pin 514. The lock arm 512 has a tooth pattern 516 that engages a corresponding tooth pattern 518 formed on the stub S. One or more gap filler members 520 can be used to fill the gap, if any, between the contour assembly 502 and the base member 508.

Together, the contour assembly 502 and the base member 508 provide a handle 500 having a base end 522 and a head end 524. The length of the handle 500 can be adjusted by disengaging the pivoting lock arm 512 from the stub S and sliding the base member 508 to a desired position. Closing the pivotal lock arm 512 relocks the base member 508 on the stub S. To limit the adjustment of the base member 508, and to prevent handle disengagement during use, a peg 526 is formed on an area of the stub S that does not carry the teeth 518. The peg 526 rides in a channel 528 formed in the sleeve half 510 that does not carry the lock arm 512.

Figure 64:
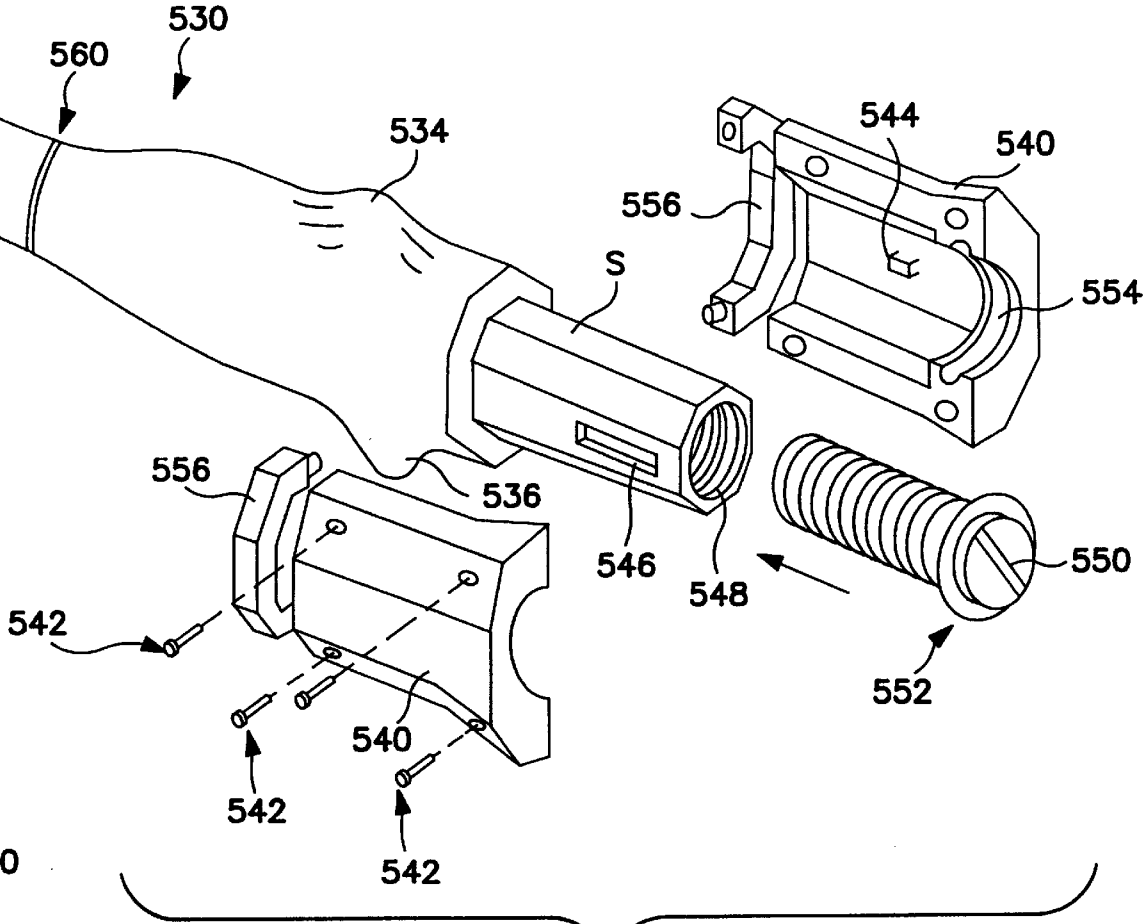
FIG. 64 is a perspective view of a racquet handle that includes a permanently mounted contour assembly, a threaded handle shaft stub extending from the contour assembly, a removable base member received on the handle shaft stub, and an adjustment bolt having a shank that threadably engages the handle shaft stub and a head that engages the base member, in accordance with another method of implementing the invention.
Figure 65:
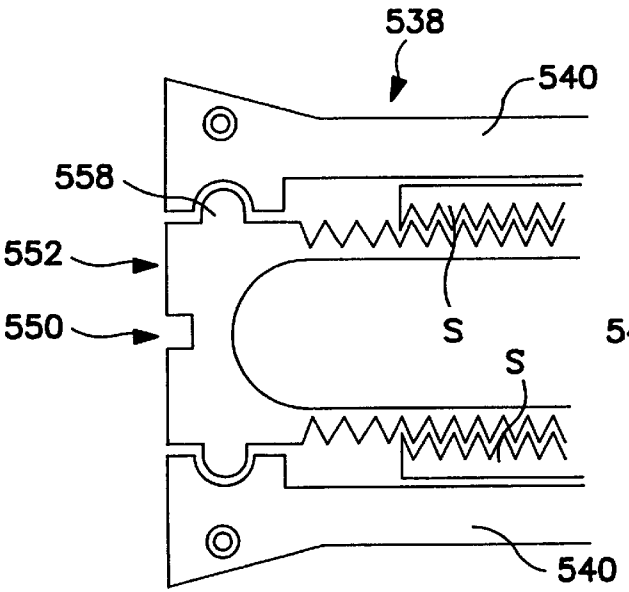
FIG. 65 is a partial cross-sectional side view of the racquet handle of FIG. 64.

Referring now to FIGS. 64 and 65, a racquet handle 530 includes a permanently mounted contour assembly 532 having a surface configuration in accordance with a designed contour that preferably includes an upper protrusion 534 and a lower trigger 536.

A removable handle base member 538 is securable to a handle shaft stub S that extends from the contour assembly 532. The base member 538 is formed with two sleeve halves 540 that can be mounted together using fasteners, such as screws 542, or other appropriate mounting methods such as adhesive bonding or sonic welding (if the sleeve halves are plastic). Each sleeve half is preferably formed with a peg 544 (only one is shown) that engages a slot 546 (only one is shown) formed in the stub S.

The stub S is formed with a threaded bore 548 that receives a base member adjustment bolt 550. The adjustment bolt 550 has a flange 552 at its head end that engages an annular slot 554 formed at one end of the base member 538.

With this arrangement, the base member 538 can be axially adjusted on the stub S by advancing or retracting the adjustment bolt 550 in the bore 548. One or more gap filler members 556 can be used to fill the gap, if any, between the contour assembly 532 and the base member 538.

Together, the contour assembly 532 and the base member 538 provide a handle 530 having a base end 558 and a head end 560. Adjustment of the length of the handle 530 is achieved using the adjustment bolt 550, as described above. This effectively changes the longitudinal position of the contour assembly 532 relative to the base end 558 of the handle 530 without having to move the contour assembly 532 on a handle shaft.

Figure 66:
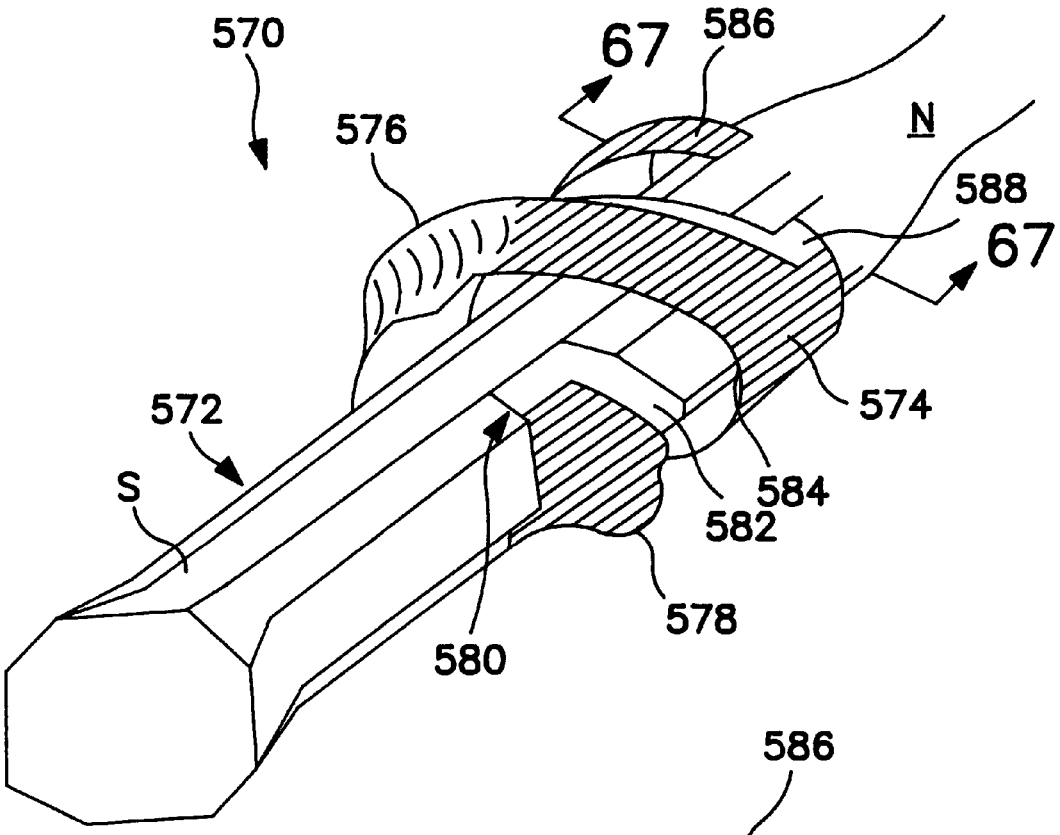
FIG. 66 is a perspective view of a racquet handle showing a contour assembly being applied thereto as a helical coil wrap in accordance with another method of implementing the invention.
Figure 67:
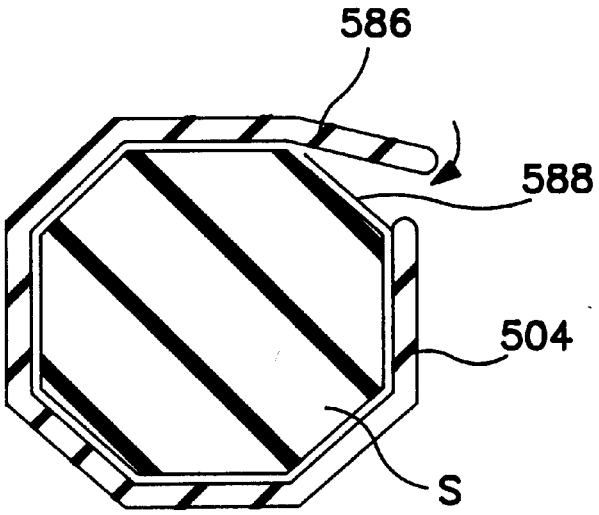
FIG. 67 is a detailed cross-sectional view taken along line 67—67 in FIG. 52.

Referring now to FIGS. 66 and 67, a handle contour assembly 570 that could be used with any of the preceding embodiments is adapted as a helical coil for wrapping around and engaging the octagonal periphery 572 of an octagonal handle shaft S extending from a neck N of a racquet. The contour assembly 570 is formed as a continuous flexible strip of material having one or more plies. Most of the contour assembly 570 is generally flat, as shown by reference numeral 574, when viewed from the side in an unwrapped configuration. Selected portions thereof have surface relief contours that are shaped to provide a protuberance 576 and a trigger 578, respectively.

The contour assembly 570 is wrapped around the handle shaft S in a clockwise direction starting at a location 580 on the handle shaft S. To facilitate wrapping, one side 582 of the contour assembly 570 is formed as a flat extension that provides an overlap area designed to be overlapped by the opposite side 584 of the contour assembly 570 as the contour assembly is wrapped around the handle shaft S. The contour assembly 570 is secured in position by applying an appropriate adhesive or other fastening implement, such as hook and loop material, between an end portion 586 of the contour assembly 500 and an intermediate portion 588 located approximately 360 degrees from the end portion 586.

Figure 68:
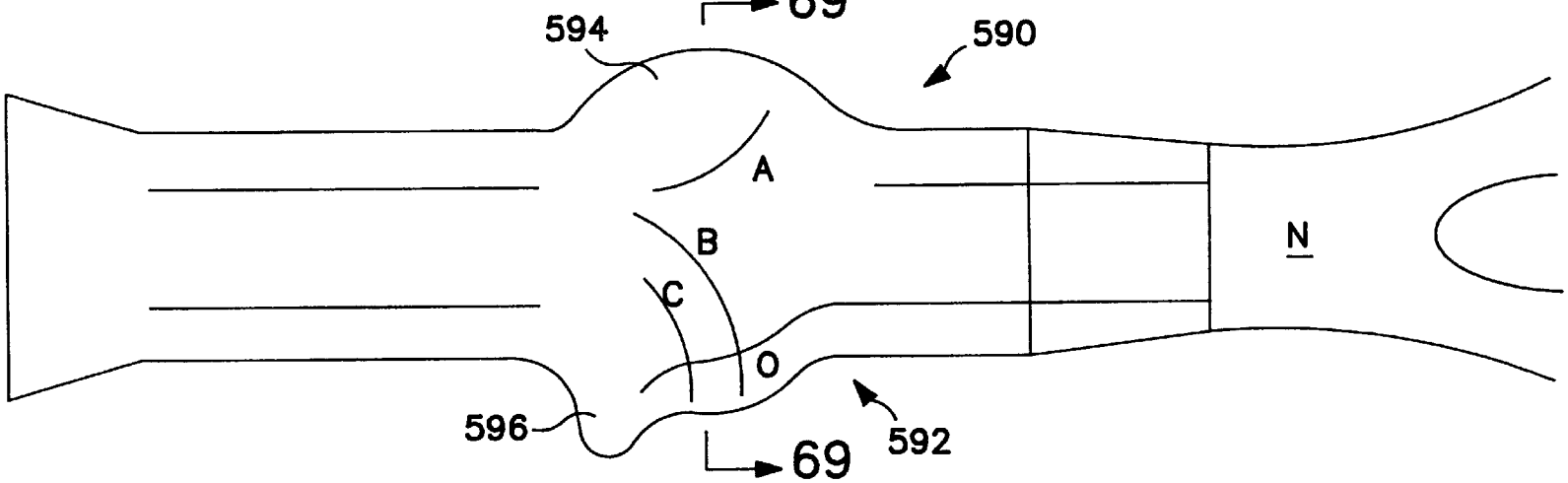
FIG. 68 is a side view of a racquet handle formed with reference ridges for guiding the placement of a player's hand thereon.
Figure 69:
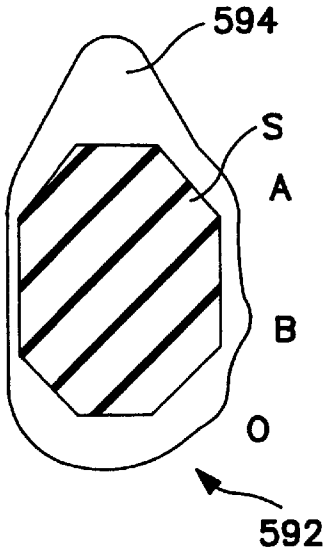
FIG. 69 is a cross-sectional view taken along line 69—69 in FIG. 68.

Referring now to FIGS. 68 and 69, a racquet handle 590 includes a contour assembly 592 that could be used in association with any of the previously-described racquet handles. The contour assembly 592 has a surface configuration in accordance with a designed contour that preferably includes an upper protrusion 594 and a lower trigger 596. The contour assembly 592 is mounted to a racquet neck N. The contour assembly 592 is formed with reference ridges or lines A, B, C and D to guide the rotational and axial placement of a user's fingers on the racquet handle 590 during game play. More specifically, as the user's hand and fingers shift or slide around from one position to another across the contour assembly 592, the reference ridges A and D provide recognizable rotational reference points. The reference ridges B and C provide recognizable references in the axial direction and also help position the user's forefinger relative to the trigger 596. Other reference ridges could also be used. If desired, the reference ridges could be color-coded or otherwise highlighted to make them more visually distinct.

Thus, various contour assemblies are formed to define a contour area of a racquet. The assemblies can have a surface configuration according to any of the embodiments shown in this or in the parent applications.

There have been described several new racquet handle configurations with means for adjustment. The embodiments described herein are illustrative of the invention but should not be construed as limitations upon the rights of the invention, which are defined by the scope of the hereinafter appended claims.

We claim:

1. A handle configuration for a racquet that supports a stringed racquet head at its outer end, and which has a racquet neck and is terminated at a base comprising a contour assembly having an exterior surface of designed contour, including an upper protuberance and a lower trigger, said contour assembly being adapted to mount to said racquet neck;

a handle stub member mounted to said contour assembly; and a handle base member mounted to said handle stub.

2. A handle configuration in accordance with claim 1 wherein said stub member is fixedly mounted to said contour assembly and said base member is adjustably mounted to said stub member.

3. A handle configuration in accordance with claim 2 wherein said base member is threadably mounted on said stub member.

4. A handle configuration in accordance with claim 2 wherein said base member is mounted to said stub member using a push button actuated detent member attached to said base member that engages inner slots formed in said stub member.

5. A handle configuration in accordance with claim 2 wherein said base member is mounted to said stub member using pegs mounted to either said stub member or base member that engage mating slot arrangements formed in the other of said stub member or base member.

6. A handle configuration in accordance with claim 2 wherein said base member is mounted to said stub member using a toothed pivoting lock member that locks into a mating tooth configuration formed in said stub member.

7. A handle configuration in accordance with claim 2 wherein said base member is mounted to said stub member using an adjustment bolt that threads into said stub member and which has a flanged head that engages said base member to axially position said base member as said adjustment bolt is advanced and retracted relative to said stub member.

8. A handle configuration in accordance with claim 1 wherein said stub member is removably mounted to said contour assembly and said base member is removably or fixedly mounted to said stub member.

9. A handle configuration in accordance with claim 8 wherein said stub member is slidably mounted in a channel formed in said contour assembly, and includes flexible tabs that engage mating recesses formed in said channel.

10. A handle configuration in accordance with claim 8 wherein said stub member is slidably mounted in a channel formed in said contour assembly, and includes spring-biased pins that engage mating slot arrangements formed in said channel.

11. A handle configuration in accordance with claim 1 wherein said contour assembly is adapted to be removably mounted to said racquet neck by way of a toothed pivoting lock member that locks into a mating tooth configuration formed in said racquet neck.

12. A handle configuration in accordance with claim 1 wherein said contour assembly is formed by a helical coil wrapped around an octagonal handle shaft.

13. A handle configuration in accordance with claim 1 wherein said contour assembly is formed with one or more finger placement reference ridges.

* * * * *